US009841263B2

(12) United States Patent
Rastegar

(10) Patent No.: US 9,841,263 B2
(45) Date of Patent: Dec. 12, 2017

(54) METHOD FOR INITIATING THERMAL BATTERY HAVING HIGH-HEIGHT DROP SAFETY FEATURE

(71) Applicant: Jahangir S Rastegar, Stony Brook, NY (US)

(72) Inventor: Jahangir S Rastegar, Stony Brook, NY (US)

(73) Assignee: OMNITEK PARTNERS L.L.C., Ronkonkoma, NY (US)

( * ) Notice: Subject to any disclaimer, the term of this patent is extended or adjusted under 35 U.S.C. 154(b) by 0 days.

(21) Appl. No.: 14/828,395

(22) Filed: Aug. 17, 2015

(65) Prior Publication Data

US 2016/0025474 A1 Jan. 28, 2016

Related U.S. Application Data

(62) Division of application No. 13/180,469, filed on Jul. 11, 2011, now Pat. No. 9,123,487.

(60) Provisional application No. 61/363,211, filed on Jul. 10, 2010.

(51) Int. Cl.

| | |
|---|---|
| ***F42C 15/24*** | (2006.01) |
| ***H01H 35/14*** | (2006.01) |
| ***F42C 19/00*** | (2006.01) |

(52) U.S. Cl.

CPC ..... *F42C 15/24* (2013.01); *H01H 35/14* (2013.01); *H01H 35/142* (2013.01); *H01H 35/145* (2013.01); *F42C 19/00* (2013.01)

(58) Field of Classification Search

CPC ..... F42C 15/00; F42C 15/005; F42C 15/20; F42C 15/24; H01H 35/14; H01H 35/141; H01H 35/142; H01H 35/145

USPC ..... 102/216, 221, 222, 247, 248, 249

See application file for complete search history.

(56) References Cited

U.S. PATENT DOCUMENTS

| | | | | |
|---|---|---|---|---|
| 7,437,995 | B2 * | 10/2008 | Rastegar | C06C 9/00 102/216 |
| 7,587,979 | B2 * | 9/2009 | Rastegar | F42C 9/02 102/222 |
| 7,587,980 | B2 * | 9/2009 | Rastegar | F42C 1/04 102/216 |
| 7,832,335 | B2 * | 11/2010 | Rastegar | F42C 15/24 102/216 |
| 8,061,271 | B2 * | 11/2011 | Murray | F42C 7/12 102/216 |
| 8,418,617 | B2 * | 4/2013 | Rastegar | H01H 35/141 102/216 |
| 8,434,408 | B2 * | 5/2013 | Rastegar | F42C 9/02 102/221 |
| 9,123,487 | B2 * | 9/2015 | Rastegar | H01H 35/142 |
| 2011/0297029 | A1 * | 12/2011 | Rastegar | F42C 15/20 102/202.1 |

* cited by examiner

*Primary Examiner* — James S Bergin

(57) ABSTRACT

A method for initiating a thermal battery including: releasing an engagement between an element and a striker mass upon an acceleration time and magnitude greater than a first threshold; and moving at least one member into a path of the element to prevent the element from releasing the striker mass only where the acceleration time and magnitude is greater than a second threshold, the second threshold being greater than the first threshold.

5 Claims, 16 Drawing Sheets

METHOD FOR INITIATING THERMAL BATTERY HAVING HIGH-HEIGHT DROP SAFETY FEATURE

CROSS-REFERENCE TO RELATED APPLICATION

This application is a Divisional application of U.S. application Ser. No. 13/180,469 filed on Jul. 11, 2011, now U.S. Pat. No. 9,123,487, which claims the benefit of U.S. Provisional Application No. 61/363,211 filed on Jul. 10, 2010, the entire contents of each of which are incorporated herein by reference.

GOVERNMENT RIGHTS

The U.S. Government has a paid-up license in this invention and the right in limited circumstances to require the patent owner to license others on reasonable terms as provided for by the terms of SBIR Grant No. DAAE30-03-C-1077 awarded by the Department of Defense on Jul. 17, 2006.

BACKGROUND OF THE INVENTION

1. Field of the Invention

The present invention relates generally to mechanical inertial igniters, and more particularly to compact and low-volume mechanical inertial igniters for thermal batteries and the like that do not initiate if dropped from relatively high-heights that result in very high impact shocks relative to the firing impact shock (setback acceleration) but which are short in duration relative to the duration of the firing setback acceleration.

2. Prior Art

Thermal batteries represent a class of reserve batteries that operate at high temperature. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters (initiators), however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to initiate at impact levels that are lower than those that result from accidental drops or nearby explosions, have to be provided with the means for distinguishing such accidental events from the firing acceleration levels. This means that safety in terms of prevention of accidental ignition is one of the main concerns in inertial igniters.

In general, electrical igniters use some type of sensors and electronics decision making circuitry to perform the aforementioned even detection tasks. Electrical igniters, however, required external electrical power sources for their operation. And considering the fact that thermal batteries (reserve batteries) are generally used in munitions to avoid the use of active batteries with their operational and shelf life limitations, and the aforementioned need for additional sensory and decision making electronics, electrical igniters are not the preferred means of activating thermal batteries and the like, particularly in gun-fired munitions, mortars and the like.

Currently available technology (U.S. Pat. Nos. 7,437,995; 7,587,979; and 7,587,980; U.S. Application Publication No. 2009/0013891 and U.S. application Ser. Nos. 61/239,048; 12/079,164; 12/234,698; 12/623,442; 12/774,324; and 12/794,763 the entire contents of each of which are incorporated herein by reference) has provided solution to the requirement of differentiating accidental drops during assembly, transportation and the like (generally for drops from up to 7 feet over concrete floors that can result in impact deceleration levels of up to 2000 G over up to 0.5 milli-seconds). The available technology differentiates the above accidental and initiation (all-fire) events by both the resulting impact induced inertial igniter (essentially the inertial igniter structure) deceleration and its duration with the firing (setback) acceleration level that is experienced by the inertial igniter and its duration, thereby allowing initiation of the inertial igniter only when the initiation (all-fire) setback acceleration level as well as its designed duration (which in gun-fired munitions of interest such as artillery rounds or mortars or the like is significantly longer than drop impact duration) are reached. This mode of differentiating the "combined" effects of accidental drop induced deceleration and all-fire initiation acceleration levels as well as their time durations (both of which would similarly tend to affect the start of the process of initiation by releasing a striker mass that upon impact with certain pyrotechnic material(s) or the like would start the ignition process) is possible since the aforementioned up to 2000 G impact deceleration level is applied over only 0.5 milli-seconds (msec), while the (even lower level) firing (setback) acceleration (generally not much lower than 900 G) is applied over significantly longer durations (generally over at least 8-10 msec).

The safety mechanisms disclosed in the above referenced patents and patent applications can be thought of as a mechanical delay mechanism, after which a separate initiation system is actuated or released to provide ignition of the device pyrotechnics. Such inertia-based igniters therefore comprise of two components so that together they provide the aforementioned mechanical safety (delay mechanism) and to provide the required striking action to achieve ignition of the pyrotechnic elements. The function of the safety system is to hold the striker in position until a specified acceleration time profile actuates the safety system and releases the striker, allowing it to accelerate toward its target under the influence of the remaining portion of the specified acceleration time profile. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

Inertial igniters that are used in munitions that are loaded into ships by cranes for transportation are highly desirable to satisfy another no-fire requirement arising from accidental dropping of the munitions from heights reached during ship loading. This requirement generally demands no-fire (no initiation) due to drops from up to 40 feet that can result in impact induced deceleration levels (of the inertial igniter structure) of up to 18,000 Gs acting over up to 1 msec time intervals. Currently, inertial igniters that can satisfy this no-fire requirement when the all-fire (setback) acceleration levels are relatively low (for example, as low as around 900 G and up to around 3000 Gs) are not available. In addition, the currently known methods of constructing inertial igniters for satisfying 7 feet drop safety (resulting in up to 2,000 Gs of impact induced deceleration levels for up to 0.5 msec impulse) requirement cannot be used to achieve safety (no-initiation) for very high impact induced decelerations resulting from high-height drops of up to 40 feet (up to 18,000 Gs of impact induced decelerations lasting up to 1 msec). This is the case for several reasons. Firstly, impacts following drops occur at significantly higher impact speeds for drops from higher heights. For example, considering free drops and for the sake of simplicity assuming that no drag to be acting on the object, impact velocities for a drop from a height of 40 feet is approximately 15.4 msec as compared to a drop from a height of 7 feet is approximately 6.4 msec, or about 2.3 times higher for 40 feet drops). Secondly, the 7 feet drops over concrete floor lasts only up to 0.5 seconds, whereas 40 feet drop induced inertial igniter deceleration levels of up to 18,000 Gs can have durations of up to 1 msec. As a result, as it is shown later in this disclosure the distance travelled by the inertial igniter striker mass releasing element is so much higher for the aforementioned 40 feet drops as compared to 7 feet drops that it has made the development of inertial igniters that are safe (no-initiation occurring) as a result of such 40 feet drops impractical.

A schematic of a cross-section of a conventional thermal battery and inertial igniter assembly is shown in FIG. 1. In thermal battery applications, the inertial igniter 10 (as assembled in a housing) is generally positioned above the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total volume that the thermal battery assembly 16 occupies within a munitions housing, it is therefore important to reduce the height of the inertial igniter 10. This is particularly important for small thermal batteries since in such cases the inertial igniter height with currently available inertial igniters can be almost the same order of magnitude as the thermal battery height.

A design of an inertial igniter for satisfying the safety (no initiation) requirement when dropped from heights of up to 7 feet (up to 2,000 G impact deceleration with a duration of up to 0.5 msec) is described below using one such embodiment disclosed in co-pending patent application Ser. No. 12/835,709, the contents of which are incorporated herein by reference. An isometric cross-sectional view of this embodiment 200 of the inertia igniter is shown in FIG. 2. The full isometric view of the inertial igniter 200 is shown in FIG. 3. The inertial igniter 200 is constructed with igniter body 201, consisting of a base 202 and at least three posts 203. The base 202 and the at least three posts 203, can be integral but may be constructed as separate pieces and joined together, for example by welding or press fitting or other methods commonly used in the art. The base of the housing 202 is also provided with at least one opening 204 (with an corresponding openings in the thermal battery—not shown) to allow the ignited sparks and fire to exit the inertial igniter into the thermal battery positioned under the inertial igniter 200 upon initiation of the inertial igniter pyrotechnics 204, FIG. 2, or percussion cap primer when used in place of the pyrotechnics as disclosed therein.

A striker mass 205 is shown in its locked position in FIG. 2. The striker mass 205 is provided with vertical surfaces 206 that are used to engage the corresponding (inner) surfaces of the posts 203 and serve as guides to allow the striker mass 205 to ride down along the length of the posts 203 without rotation with an essentially pure up and down translational motion. The vertical surfaces 206 may be recessed to engage the inner three surfaces of the properly shaped posts 203.

In its illustrated position in FIGS. 2 and 3, the striker mass 205 is locked in its axial position to the posts 203 by at least one setback locking ball 207. The setback locking ball 207 locks the striker mass 205 to the posts 203 of the inertial igniter body 201 through the holes 208 provided in the posts 203 and a concave portion such as a dimple (or groove) 209 on the striker mass 205 as shown in FIG. 2. A setback spring 210, which is preferably in compression, is also provided around but close to the posts 203 as shown in FIGS. 2 and 3. In the configuration shown in FIG. 2, the locking balls 207 are prevented from moving away from their aforementioned locking position by the collar 211. The collar 211 can be provided with partial guide 212 ("pocket"), which are open on the top as indicated by numeral 213. The guides 213 may be provided only at the locations of the locking balls 207 as shown in FIGS. 2 and 3, or may be provided as an internal surface over the entire inner surface of the collar 211 (not shown). The advantage of providing local guides 212 is that it would result in a significantly larger surface contact between the collar 211 and the outer surfaces of the posts 203, thereby allowing for smoother movement of the collar 211 up and down along the length of the posts 203. In addition, they would prevent the collar 211 from rotating relative to the inertial igniter body 201 and makes the collar stronger and more massive. The advantage of providing a continuous inner recess guiding surface for the locking balls 207 is that it would require fewer machining processes during the collar manufacture.

The collar 211 can ride up and down the posts 203 as can be seen in FIGS. 2 and 3, but is biased to stay in its upper most position as shown in FIGS. 2 and 3 by the setback spring 210. The guides 212 are provided with bottom ends 214, so that when the inertial igniter is assembled as shown in FIGS. 2 and 3, the setback spring 210 which is biased (preloaded) to push the collar 211 upward away from the igniter base 201, would hold the collar 211 in its uppermost position against the locking balls 207. As a result, the assembled inertial igniter 200 stays in its assembled state and would not require a top cap to prevent the collar 211 from being pushed up and allowing the locking balls 207 from moving out and releasing the striker mass 205.

In this embodiment, a one part pyrotechnics compound 215 (such as lead styphnate or some other similar compounds) is used as shown in FIG. 2. The surfaces to which the pyrotechnic compound 215 is attached can be roughened and/or provided with surface cuts, recesses, or the like and/or treated chemically as commonly done in the art (not shown) to ensure secure attachment of the pyrotechnics material to the applied surfaces. The use of one part pyrotechnics compound makes the manufacturing and assembly process much simpler and thereby leads to lower inertial igniter cost. The striker mass is preferably provided with a relatively sharp tip 216 and the igniter base surface 202 is provided with a protruding tip 217 which is covered with the pyrotechnics compound 215, such that as the striker mass is released during an all-fire event and is accelerated down, impact occurs mostly between the surfaces of the tips 216 and 217, thereby pinching the pyrotechnics compound 215, thereby providing the means to obtain a reliable initiation of the pyrotechnics compound 215.

Alternatively, a two-part pyrotechnics compound, e.g., potassium chlorate and red phosphorous, may be used. When using such a two-part pyrotechnics compound, the first part, in this case the potassium chlorate, can be provided on the interior side of the base in a provided recess, and the second part of the pyrotechnics compound, in this case the red phosphorous, is provided on the lower surface of the striker mass surface facing the first part of the pyrotechnics compound. In general, various combinations of pyrotechnic materials may be used for this purpose with an appropriate binder to firmly adhere the materials to the inertial igniter (e.g., metal) surfaces.

Alternatively, instead of using the pyrotechnics compound 215, FIG. 2, a percussion cap primer can be used. An appropriately shaped striker tip can be provided at the tip 216 of the striker mass 205 (not shown) to facilitate initiation upon impact.

The basic operation of the embodiment 200 of the inertial igniter of FIGS. 2 and 3 is now described. In case of any non-trivial acceleration in the axial direction 218 which can cause the collar 211 to overcome the resisting force of the setback spring 210 will initiate and sustain some downward motion of the collar 211. The force due to the acceleration on the striker mass 205 is supported at the dimples 209 by the locking balls 207 which are constrained inside the holes 208 in the posts 203. If the acceleration is applied over long enough time in the axial direction 218, the collar 211 will translate down along the axis of the assembly until the setback locking balls 205 are no longer constrained to engage the striker mass 205 to the posts 203. If the event acceleration and its time duration is not sufficient to provide this motion (i.e., if the acceleration level and its duration are less than the predetermined threshold), the collar 211 will return to its start (top) position under the force of the setback spring 210 once the event has ceased.

Assuming that the acceleration time profile was at or above the specified "all-fire" profile, the collar 211 will have translated down past the locking balls 207, allowing the striker mass 205 to accelerate down towards the base 202. In such a situation, since the locking balls 207 are no longer constrained by the collar 211, the downward force that the striker mass 205 has been exerting on the locking balls 207 will force the locking balls 207 to move outward in the radial direction. Once the locking balls 207 are out of the way of the dimples 209, the downward motion of the striker mass 205 is no longer impeded. As a result, the striker mass 205 accelerates downward, causing the tip 216 of the striker mass 205 to strike the pyrotechnic compound 215 on the surface of the protrusion 217 with the requisite energy to initiate ignition.

In the embodiment 200 of the inertial igniter shown in FIGS. 2 and 3, the setback spring 210 is of a helical wave spring type fabricated with rectangular cross-sectional wires (such as the ones manufactured by Smalley Steel Ring Company of Lake Zurich, Ill.). This is in contrast with the helical springs with circular wire cross-sections used in other available inertial igniters. The use of the aforementioned rectangular cross-section wave springs or the like has the following significant advantages over helical springs that are constructed with wires with circular cross-sections. Firstly and most importantly, as the spring is compressed and nears its "solid" length, the flat surfaces of the rectangular cross-section wires come in contact, thereby generating minimal lateral forces that would otherwise tend to force one coil to move laterally relative to the other coils as is usually the case when the wires are circular in cross-section. Lateral movement of the coils can, in general, interfere with the proper operation of the inertial igniter since it could, for example, jam a coil to the outer housing of the inertial igniter (not shown in FIGS. 2 and 3), which is usually desired to house the igniter 200 or the like with minimal clearance to minimize the total volume of the inertial igniter. In addition, the laterally moving coils could also jam against the posts 203 thereby further interfering with the proper operation of the inertial igniter. The use of the wave springs with rectangular cross-section would therefore significantly increase the reliability of the inertial igniter and also significantly increase the repeatability of the initiation for a specified all-fire condition. The second advantage of the use of the aforementioned wave springs with rectangular cross-section, particularly since the wires can and are usually made thin in thickness and relatively wide, is that the solid length of the resulting wave spring can be made to be significantly less than an equivalent regular helical spring with circular cross-section. As a result, the total height of the resulting inertial igniter can be reduced. Thirdly, since the coil waves are in contact with each other at certain points along their lengths and as the spring is compressed, the length of each wave is slightly increased, therefore during the spring compression the friction forces at these contact points do certain amount of work and thereby absorb certain amount of energy. The presence of this friction force ensures that the firing acceleration and very rapid compression of the spring would to a lesser amount tend to "bounce" the collar 211 back up and thereby increasing the possibility that it would interfere with the exit of the locking balls from the dimples 209 of the striker mass 205 and the release of the striker mass 205. The above characteristic of the wave springs with rectangular cross-section should therefore also significantly enhance the performance and reliability of the inertial igniter 200 while at the same time allowing its height (and total volume) to be reduced.

The striker mass 205 and striker tip 216 may be a monolithic design with the striking tip 216 being machined as shown in FIG. 2 or as a boss protruding from the striker mass, or the striker tip 216 may be a separate piece, possibly fabricated from a material that is significantly harder than the striker mass material, and pressed or otherwise permanently fixed to the striker mass. A two-piece design would be favorable to the need for a striker whose density is different than steel, but whose tip would remain hard and tough by attaching a steel ball, hemisphere, or other shape to the striker mass. A monolithic design, however, would be generally favorable to manufacturing because of the reduction of part quantity and assembly operations.

In the embodiment 200 of FIGS. 2 and 3, following ignition of the pyrotechnics compound 215, the generated flames and sparks are designed to exit downward through the opening 204 to initiate the thermal battery below. Alternatively, if the thermal battery is positioned above the inertial igniter 200, the opening 204 can be eliminated and the striker mass could be provided with at least one opening (not shown) to guide the ignition flame and sparks up through the striker mass 205 to allow the pyrotechnic materials (or the like) of a thermal battery (or the like) positioned above the inertial igniter 200 (not shown) to be initiated.

Alternatively, side ports may be provided to allow the flame to exit from the side of the igniter to initiate the pyrotechnic materials (or the like) of a thermal battery or the like that is positioned around the body of the inertial igniter. Other alternatives known in the art may also be used.

In FIGS. 2 and 3, the inertial igniter embodiment 200 is shown without any outside housing. In many applications, as shown in the schematics of FIG. 4*a* (4*b*), the inertial igniter 240 (250) is placed securely inside the thermal battery 241 (251), either on the top (FIG. 4*a*) or bottom (FIG. 4*b*) of the thermal battery housing 242 (252). This is particularly the case for relatively small thermal batteries. In such thermal battery configurations, since the inertial igniter 240 (250) is inside the hermetically sealed thermal battery 241 (251), there is no need for a separate housing to be provided for the inertial igniter itself. In this assembly configuration, the thermal battery housing 242 (252) is provided with a separate compartment 243 (253) for the inertial igniter. The inertial igniter compartment 243 (253) is preferably formed by a member 244 (254) which is fixed to the inner surface of the thermal battery housing 242 (253), preferably by welding, brazing or very strong adhesives or the like. The separating member 244 (254) is provided with an opening 245 (255) to allow the generated flame and sparks following the initiation of the inertial igniter 240 (250) to enter the thermal battery compartment 246 (256) to activate the thermal battery 241 (251). The separating member 244 (254) and its attachment to the internal surface of the thermal battery housing 242 (252) must be strong enough to withstand the forces generated by the firing acceleration.

For larger thermal batteries, a separate compartment (similar to the compartment 10 over or possibly under the thermal battery hosing 11 as shown in FIG. 1) can be provided above, inside or under the thermal battery housing for the inertial igniter. An appropriate opening (similar to the opening 12 in FIG. 1) can also be provided to allow the flame and sparks generated as a result of inertial igniter initiation to enter the thermal battery compartment (similar to the compartment 14 in FIG. 1) and activate the thermal battery.

The inertial igniter 200, FIGS. 2 and 3 may also be provided with a housing 260 as shown in FIG. 5. The housing 260 can be one piece and fixed to the base 202 of the inertial igniter structure 201, such as by soldering, laser welding or appropriate epoxy adhesive or any other of the commonly used techniques to achieve a sealed compartment. The housing 260 may also be crimped to the base 202 at its open end 261, in which case the base 202 can be provided with an appropriate recess 262 to receive the crimped portion 261 of the housing 260. The housing can be sealed at or near the crimped region via one of the commonly used techniques such as those described above.

It is appreciated by those skilled in the art that by varying the mass of the striker 205, the mass of the collar 211, the spring rate of the setback spring 210, the distance that the collar 211 has to travel downward to release the locking balls 207 and thereby release the striker mass 205, and the distance between the tip 216 of the striker mass 205 and the pyrotechnic compound 215 (and the tip of the protrusion 217), the designer of the disclosed inertial igniter 200 can try to match the all-fire and no-fire impulse level requirements for various applications as well as the safety (delay or dwell action) protection against accidental dropping of the inertial igniter and/or the munitions or the like within which it is assembled.

Briefly, the safety system parameters, i.e., the mass of the collar 211, the spring rate of the setback spring 210 and the dwell stroke (the distance that the collar 210 has to travel downward to release the locking balls 207 and thereby release the striker mass 205) must be tuned to provide the required actuation performance characteristics. Similarly, to provide the requisite impact energy, the mass of the striker 205 and the aforementioned separation distance between the tip 216 of the striker mass and the pyrotechnic compound 215 (and the tip of the protrusion 217) must work together to provide the specified impact energy to initiate the pyrotechnic compound when subjected to the remaining portion of the prescribed initiation acceleration profile after the safety system has been actuated.

However, as it was previously shown, when the firing (setback) acceleration is relatively low (for example, in the range of 900-3000 Gs—usually lasting around 8-15 msec), the currently available methods cannot be used to design inertial igniters that are safe (i.e., do not initiate) when dropped from heights of up to 40 feet (which can generate inertial igniter impact deceleration levels of up to 18,000 Gs with durations of up to 1 msec). As a result, mechanical inertial igniters that can satisfy this safety (no initiation) requirement when the all-fire (setback) acceleration levels are relatively low have not been available.

This was shown above to be case since for drops from high-heights of the order of 40 feet that result in impact induced inertial igniter deceleration levels of up to 18,000 Gs with durations of up to 1 msec, due to the high velocity of the inertial igniter and its various elements (including the collar 211, FIG. 2) at the time of impact and the long duration of the impact induced inertial igniter deceleration, the amount of downward travel of the collar 211 (FIG. 2) relative to the inertial igniter body (element 203) will become so long that makes such inertial igniters impractical for munitions applications. This is particularly the case for inertial igniters used in munitions with relatively low all-fire (setback) acceleration levels, since the compressive preload in the striker spring 210 (FIG. 2) needs to be low (since the dynamic force resulting by the firing acceleration acting on the inertia of the collar 211 must be significantly less than the compressive preloading level of the striker spring 210 to allow the release of the striker mass 205 when all-fire acceleration level is reached and thereby cause igniter initiation), thereby the fast downward translation of the collar 211 relative to the inertial igniter body 203 is minimally impeded by the upward force generated by the striker spring 210.

Thus, it is shown that it is not possible to use the methods used in the design of currently available inertial igniters to provide no-fire safety for accidental drops from height of up to 7 feet (such as those described in the aforementioned patents and patent applications) to design inertial igniters that provide no-fire safety for the aforementioned drops from heights of up to 40 feet.

In addition, in recent years, new and improved chemistries and manufacturing processes have been developed that promise the development of lower cost and higher performance thermal batteries that could be produced in various shapes and sizes, including their small and miniaturized versions. Thus, it is important that the developed inertial igniters be relatively small and suitable for small and low power thermal batteries, particularly those that are being developed for use in miniaturized fuzing, future smart munitions, and other similar applications.

SUMMARY OF THE INVENTION

A need therefore exist for methods to design mechanical inertial igniters that could satisfy high-height drop safety (no-fire) requirements while satisfying relatively low all-fire firing (setback) acceleration requirement.

A need also exists for mechanical inertial igniters that are developed based on the above methods and that can satisfy the safety requirement of drops from high-heights of up to 40 feet that could generate impact induced deceleration rates of up to 18,000 Gs or even higher.

A need therefore exists for novel miniature mechanical inertial igniters for thermal batteries used in gun-fired munitions, mortars and the like, particularly for small and low power thermal batteries that could be used in fuzing and other similar applications, that are safe (i.e., do not initiate) when dropped from relatively high-heights, such as up to 40 feet. Dropping from heights of up to 40 feet have been shown that can subject the device to impact deceleration levels of up to 18,000 Gs with the duration of up to 1 msec. Such innovative inertial igniters are highly desired to be scalable to thermal batteries of various sizes, in particular to miniaturized inertial igniters for small size thermal batteries. Such inertial igniters are generally also required not to initiate if dropped from heights of up to 7 feet onto a concrete floor, which can result in impact induced inertial igniter decelerations of up to of 2000 G that may last up to 0.5 msec. The inertial igniters are also generally required to withstand high firing accelerations, for example up to 20-50,000 Gs (i.e., not to damage the thermal battery); and should be able to be designed to ignite at specified acceleration levels when subjected to such accelerations for a specified amount of time to match the firing acceleration. High reliability is also of much concern in inertial igniters. In addition, the inertial igniters used in munitions are generally required to have a shelf life of better than 20 years and could generally be stored at temperatures of sometimes in the range of −65 to 165 degrees F. This requirement is usually satisfied best if the igniter pyrotechnic is in a sealed compartment. The inertial igniter designs must also consider the manufacturing costs and simplicity in the designs to make them cost effective for munitions applications.

Accordingly, methods are provided that can be used to design fully mechanical inertial igniters that can satisfy high-height drop safety (no-fire) requirements while satisfying relatively low all-fire firing (setback) acceleration level requirement. In addition, several embodiments are also provided for the design of such high-height-drop-safe inertial igniters for use in gun-fired munitions, mortars and the like.

To ensure safety and reliability, inertial igniters should not initiate during acceleration events which may occur during manufacture, assembly, handling, transport, accidental drops, etc. Additionally, once under the influence of an acceleration profile particular to the firing of ordinance from a gun, the device should initiate with high reliability. It is also conceivable that the igniter will experience incidental low but long-duration accelerations, whether accidental or as part of normal handling, which must be guarded against initiation. Again, the impulse given to the miniature inertial igniter will have a great disparity with that given by the initiation acceleration profile because the magnitude of the incidental long-duration acceleration will be quite low.

Those skilled in the art will appreciate that the inertial igniters disclosed herein may provide one or more of the following advantages over prior art inertial igniters:

provide inertial igniters that are safe when dropped from very high-heights of up to 40 feet;

provide inertial igniters that allow the use of standard off-the-shelf percussion cap primers or commonly used one part or two part pyrotechnic components; and provide inertial igniters that can be sealed to simplify storage and increase their shelf life.

Accordingly, an inertial igniter is provided. The inertial igniter comprising: a striker mass movable towards one of a percussion cap or pyrotechnic material; an element movable with the striker mass for releasing the striker mass to strike the percussion cap or pyrotechnic material upon an acceleration time and magnitude greater than a first threshold; and at least one member configured to be movable into a path of the element to prevent the element from releasing the striker mass only where the acceleration time and magnitude is greater than a second threshold, the second threshold being greater than the first threshold.

The inertial igniter can further comprise one or more balls retaining the striker mass to the element during periods where the acceleration time and magnitude are less than the first threshold.

The inertial igniter can further comprise a biasing member for biasing the element away from a base structure.

The element can further include a projecting surface, wherein the member is movable into the path to engage with the projecting surface to prevent the element from releasing the striker mass only where the acceleration time and magnitude is greater than a second threshold.

The at least one member can be movable in translation into the path. The translation can be along an inclined path.

The at least one member can be configured to rotate into the path. The at least one member can rotate about a pivot into the path. The at least one member can rotate about a deforming member into the path.

The at least one member can be configured to be returnable from the path when the acceleration time and magnitude lowers from the second threshold.

The at least one member can be configured to remain in the path after the acceleration time and magnitude reaches the second threshold.

The inertial igniter can further comprise a biasing member for biasing the at least one member in a direction away from moving into the path.

The inertial igniter can further comprise a biasing member for biasing the at least one member in a direction towards moving into the path.

The inertial igniter can further comprise a biasing member configured to bias the at least one member away from the path when the acceleration time and magnitude is less than the second threshold and to bias the at least one member into the path when the acceleration time and magnitude is greater than the second threshold.

The at least one member can comprise two or more members, each movable into the path of the element to prevent the element from releasing the striker mass only where the acceleration time and magnitude is greater than the second threshold.

Also provided is a method for initiating a thermal battery. The method comprising: releasing an engagement between an element and a striker mass upon an acceleration time and magnitude greater than a first threshold; and moving at least one member into a path of the element to prevent the element from releasing the striker mass only where the acceleration time and magnitude is greater than a second threshold, the second threshold being greater than the first threshold.

The moving can comprise translating the at least one member into the path.

The moving can comprise rotating the at least one member into the path.

The method can further comprise returning the at least one member from the path when the acceleration time and magnitude lowers from the second threshold.

The method can further comprise maintaining the at least one member in the path after the acceleration time and magnitude reaches the second threshold.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 6:
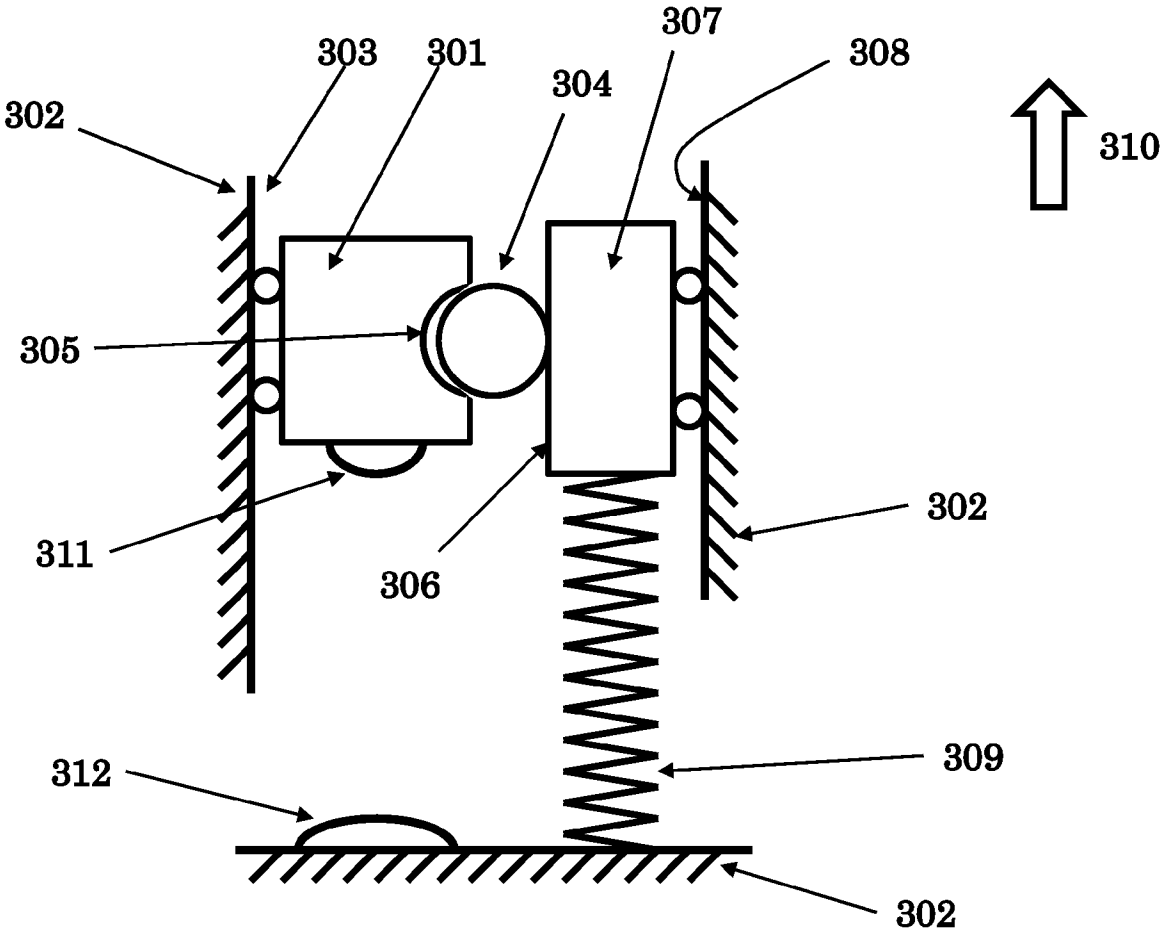
Figure 6 (Prior Art)
FIG. 6 illustrates a schematic of the basic components used to describe the operation of currently available mechanical inertial igniters with 7 feet drop safety mechanism.
Figure 7:
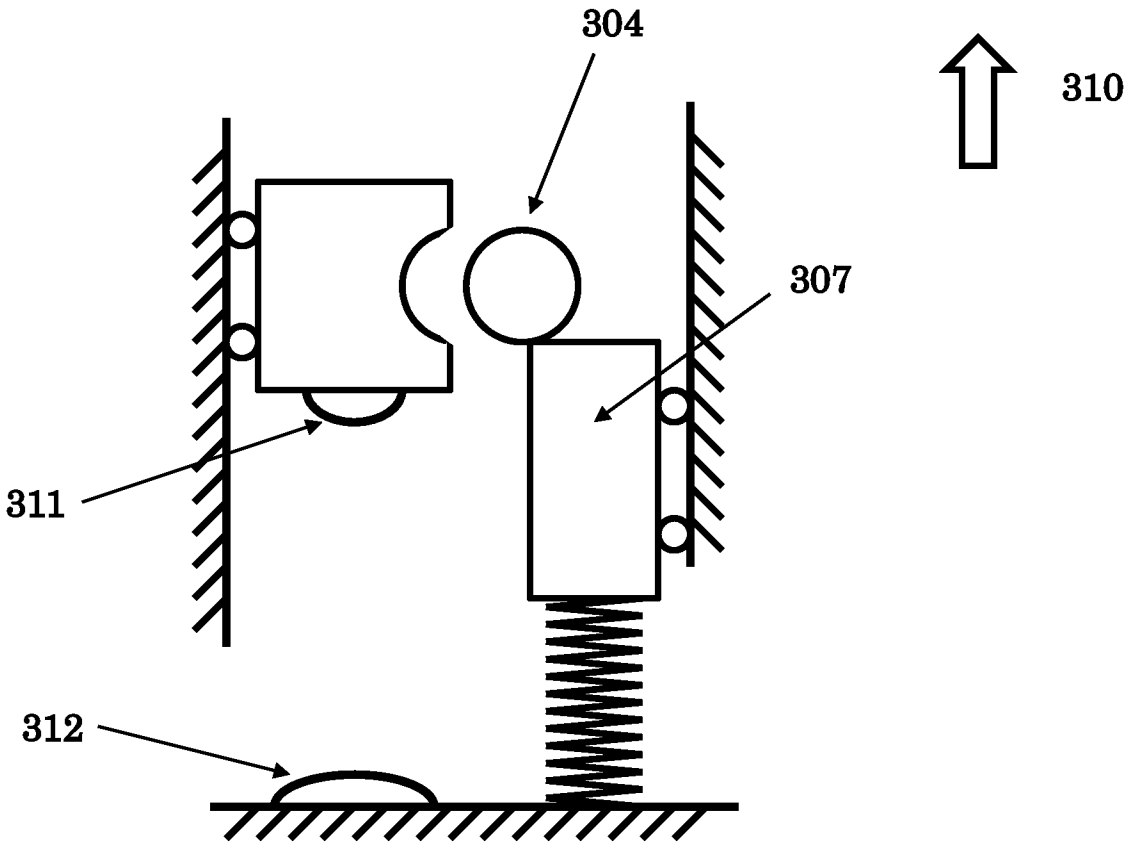
Figure 7 (Prior Art)
FIG. 7 illustrates a schematic of the basic inertial igniter design of FIG. 6 as the all-fire condition is reached and the striker mass is released.

Referring now to the schematic of FIG. 6, which is used to describe basic mechanism used in currently available mechanical inertial igniters to satisfy safety (no initiation) requirement for drops from heights of up to 7 feet over a concrete floor (resulting in up to 2,000 G of impact deceleration of the inertial igniter structure over up to 0.5 msec). The basic mechanical inertial igniters are provided with a striker mass 301, which when free, can slide down against the surface 303 of the inertial igniter structure 302. Before being activated, the striker mass 301 is held fixed to the inertial igniter structure 302 by the mechanically interfering element (in the schematic of FIG. 6, the ball) 304, which engages the striker mass 301 in the provided dimple 305. In this state, the ball 304 rests against the surface 306 of the element 307, thereby it is prevented from disengaging the element 301, i.e., to move to the right and out of the dimple 305. The element 307 is free to slide along the surface 308 of the inertial igniter structure 302. The element 307 is also attached to the inertial igniter structure 302 via the spring element 309, which is attached to the element 307 on one side and to the inertial igniter structure 302 on the other side. The direction of the firing acceleration (setback) is considered to be as indicated by the arrow 310. If the inertial igniter is dropped from a certain height, e.g., from the aforementioned 7 feet over a concrete floor and strike the floor while vertically oriented as shown in FIG. 6, the resulting impact causes the inertial igniter to be decelerated (accelerated in the direction of the arrow 310). Following impact, the element 307 is decelerated from its initial (downward) velocity at the time of impact at a rate proportional to the ratio of the (instantaneous upward) force applied to the element 307 by the spring element 309 (neglecting friction and other usually incidental forces) and the mass of the element 307. Considering the fact that the spring element 309 may be preloaded in compression, the motion of the element 307 relative to the structure of the inertial igniter is determined by the net (external) force acting on the element 307. If the level of said deceleration stays high enough and act over long enough period of time, then the element 307 moves down enough to allow the locking ball 304 to be pushed out of the dimple 305 by the dynamic force acting on the inertial of the striker mass 301 as shown in FIG. 7. The striker mass 301 is then accelerated downward, causing the pyrotechnic elements 311 and 312 (alternatively one part pyrotechnic material 312 and the striker tip 311) to impact and initiate the igniter. Otherwise, if the inertial igniter impact induced deceleration ends before the striker mass 301 is released, the element 307 is pushed back up to its pre-impact position by the spring element 309, securing the striker mass 301 via the locking ball 304. Similar excursions of the element 307 may occur during transportation induced movements (acceleration/deceleration cycles applied to the inertial igniter) without causing the striker mass 301 to be released. The safety requirements for inertial igniter transportation and drops from heights of up to 7 feet over concrete floor are designed to be satisfied as previously discussed by selecting appropriate values for the mass of the element 307, the level of preloading of the spring element 309 and its rate, and the distance that the element 307 has to travel down before the locking ball 304 is released.

It is noted that in practice, the upward motion of the element 307 is usually constrained (preferably mechanically) so that the spring element 309 could be preloaded in compression.

The present exemplary devices and methods set forth below can be used to design inertial igniters and the like that can overcome the shortcomings of the prior art, i.e., that can satisfy the safety (no initiation) requirement of drops from heights of up to 40 feet (which can generate impact deceleration levels of up to 18,000 Gs with durations of up to 1 msec) for gun-fired munitions, mortars and the like with relatively low firing (setback) acceleration levels (for example, in the range of 900-3000 Gs—usually lasting around 8-15 msec).

The basic inertial igniter device design shown in the schematic of FIGS. 6 and 7 is used in this illustration (FIG. 8) with added mechanisms (hereinafter called "deployable locking mechanisms") to be described to arrive at inertial igniters that in addition to satisfying the aforementioned requirements of safety (no initiation) when dropped from 7 feet to concrete floors and safety (no initiation) in response to low levels of relatively long term acceleration and deceleration cycles during transportation or the like, would also satisfy the requirement of safety (no initiation) when dropped from high-heights such as up to 40 feet which could result in up to 18,000 Gs of impact induced deceleration of the inertial igniter structure (FIGS. 7 and 8) with up to 1 msec of duration.

Figure 8:
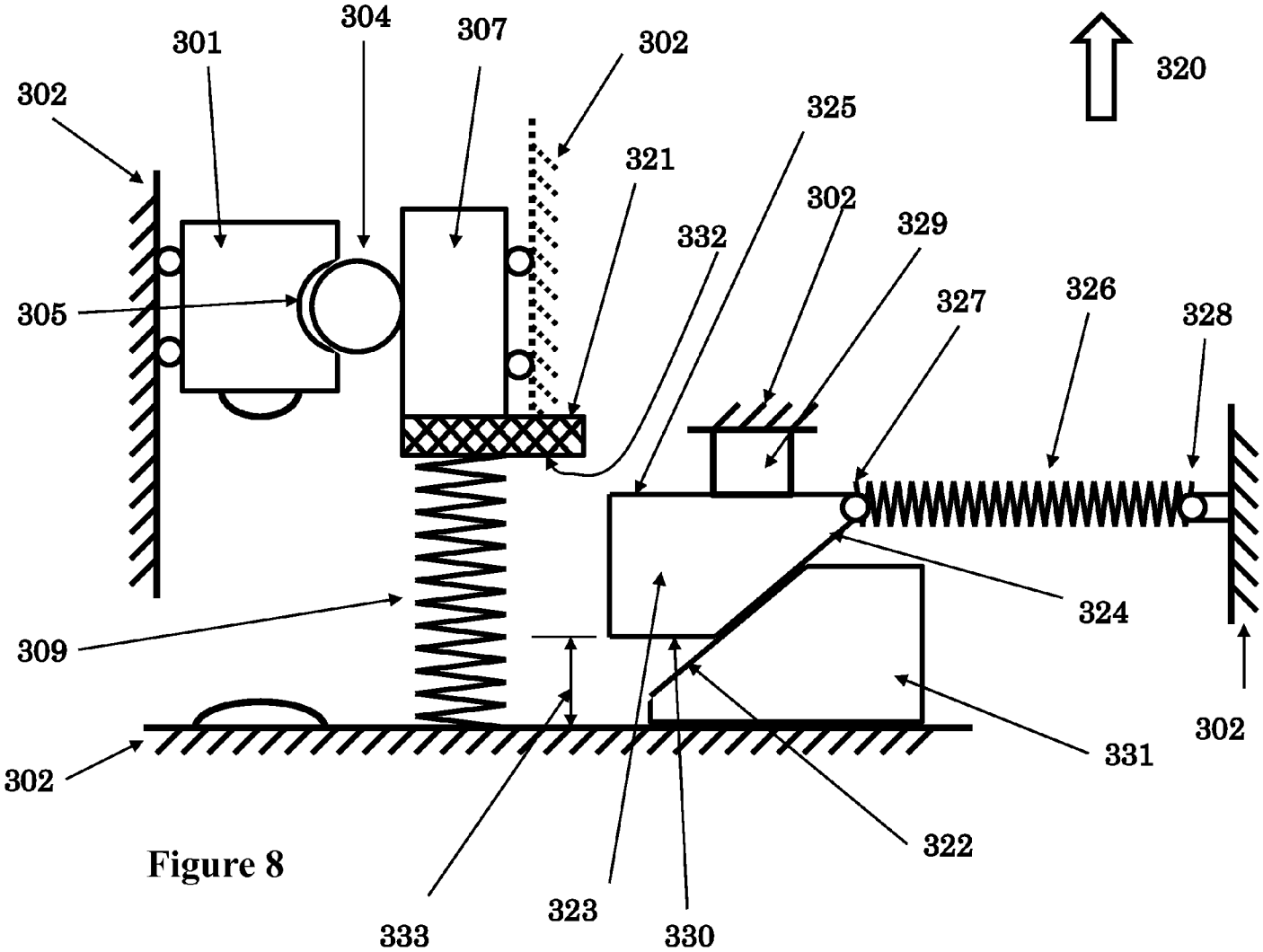
FIG. 8 illustrates a schematic of the basic components used to describe the operation of currently available mechanical inertial igniters with 7 feet drop safety mechanism with the added "deployable locking mechanism" for providing for safety (no initiation) for high-height drops from up to 40 feet.

As can be seen in the schematic of FIG. 8, the element 307 is provided with a protruding step 321. It is noted that as it was previously described, that the element 307 serves to prevent the release of the striker mass 301 by preventing the locking ball 304 from moving out of the dimple 305 of the striker mass 301. In the present device and method, a "deployable locking mechanism" is provided that engages the provided step 321 (or other similarly provided motion constraining surface on the element 307) and prevents it from moving down far enough to allow the release of the locking ball 304 when the inertial igniter is subjected to impact induced (or explosion or the like) in the direction parallel to that of the arrow 320 corresponding to drops from high-heights of up to 40 feet (which can generate impact deceleration levels of up to 18,000 Gs with durations of up to 1 msec).

It is appreciated by those skilled in the art that numerous types and designs of mechanical mechanisms may be used for the aforementioned deployable locking mechanism. The only operational requirement for such deployable locking mechanism is that up to a predetermined acceleration threshold it should not deploy, but once the predetermined acceleration threshold has been reached, it should deploy and provide a mechanical stop in the downward path of motion of the element 307 such that it is prevented from moving down far enough to allow the locking ball 304 to disengage the striker mass 301.

It is also appreciated by those skilled in the art that the aforementioned embodiment of the deployment mechanism shown in the schematic of FIG. 8 is exemplary and provided mainly to describe the disclosed method of providing the aforementioned high-drop safety requirements for mechanical inertial igniters.

It is appreciated by those skilled in the art that such "deployable locking mechanisms" may be designed to deploy as a result of other events, such as lateral impact (perpendicular to the direction of the arrow 320). In addition, the inertial igniter may be provided with more than one type of "deployable locking mechanisms" that operate independently and deploy if either one of the considered events occurs.

In the embodiment of FIG. 8, the "deployable locking mechanism" consists of a solid element 331 which is fixed to the inertial igniter 302. The element 331 is provided with an inclined surface 322. A second solid movable element 323 with a matching inclined surface 324 is positioned as shown over the element 331. The inclined surfaces 322 and 324 of the elements 331 and 323 are held in contact, allowing the element 323 to slide up or down along this inclined surface of contact. The element 323 is held in place and is prevented from sliding down along the inclined surfaces of contact by a spring (elastic) element 326, which is attached to the element 323 at one end (such as through a rotary joint 327 or the like) and to the structure of the inertial igniter 302 at the other end (such as through a second rotary joint 328 or the like). The spring element 326 can be preloaded in tension, while the upward movement of element 323 is constrained by the stop 329, which is fixed to the structure of the inertial igniter 302.

Figure 9:
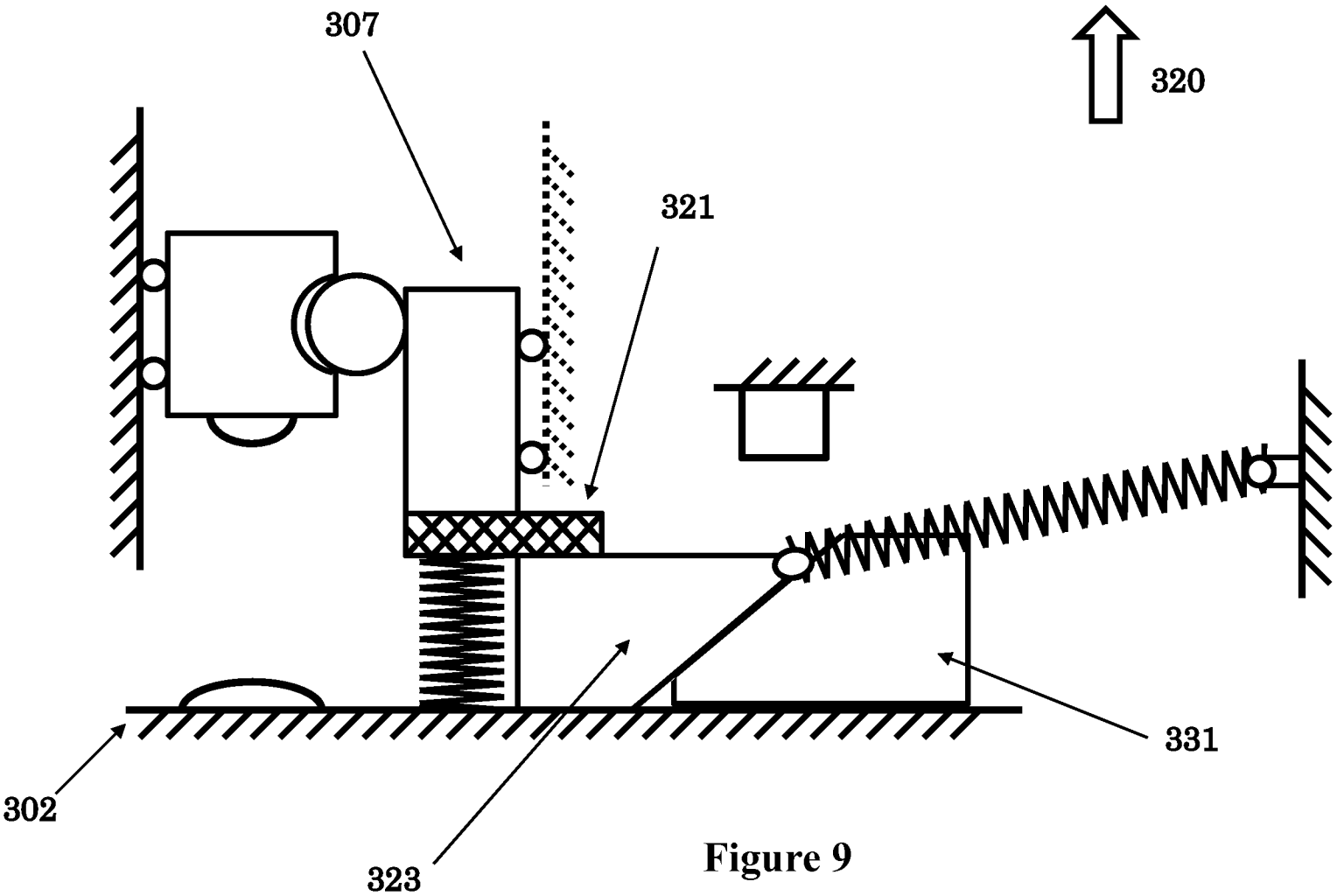
FIG. 9 illustrates a schematic of the basic inertial igniter of FIG. 8 following a high-height drop with deployed initiation blocking "deployable locking mechanism".

The "deployable locking mechanism" works as follows. If the inertial igniter is dropped such that it impacts a solid surface vertically (in a direction parallel to the arrow 320), during the impact, the element 323 is decelerated in the direction the arrow 320 from its initial velocity at the time of impact. The level of deceleration is obviously proportional to the net force acting on the inertia of the element 323. The net decelerating force is due mainly to the components of the force applied by the spring element 326 and the contact (reaction) force between the contacting surfaces 322 and 324 and other (usually incidental) forces such as those generated by friction, in a direction parallel to the direction of the arrow 320. The resisting force offered by the spring element 326 is generated since the spring element 326 is preloaded in tension. As a result, the spring element 326 resists downwards motion of the element 323 due to the presence of inclined surfaces of contact 324 and 322, FIG. 8. Thus, if the aforementioned initial velocity of the element 323 at the time of inertial igniter drop induced impact is high enough (given the slope of the surfaces 324 and 322, the tensile preloading level of the spring 326 and its rate and the level of friction and other said forces acting on the element 323), the resistance of the spring element 326 (and friction between the surfaces 324 and 322) is overcome, and the element 323 begins to slide down the surface 322 of the element 331, causing the element 323 to move down as well as to move towards the left. If the impact induced deceleration level of the inertial igniter is high enough and its duration is long enough, then the element 323 travels down until its bottom surface 330 comes into contact with the surface of the inertial igniter structure 302. By this time, the top surface 325 of the element 323 is positioned under the bottom surface 332 of the protruding portion (step) 321, thereby preventing the element 307 from moving down enough to cause the locking ball 304 to be disengaged from the striker mass 301 as shown in FIG. 9. This scenario obviously assumes that the locking element 323 of the "deployable locking mechanism" moves far enough to the left and under the protruding element 321 by the time the element 307 has moved down enough to interfere with the movement of the locking element 323.

As described above, with the addition of the aforementioned "deployable locking mechanism" as shown in FIGS. 8 and 9, mechanical inertial igniters can be designed to satisfy the safety (no initiation) requirement of drops from heights of up to 40 feet (which can generate impact deceleration levels of up to 18,000 Gs with durations of up to 1 msec) for gun-fired munitions, mortars and the like, when the firing (setback) acceleration levels are relatively low (for example, in the range of 900-3000 Gs—usually lasting around 8-15 msec). It is noted that the design parameters provided by the aforementioned "deployable locking mechanism" include the geometries of the elements 323, 331 and the protrusion 321; the inertia of the element 323 and its distance 333 (FIG. 8) from the inertial igniter structure 302; and the attachment points, length and rate of the spring element 326. A few examples showing how a wide range of all-fire and no-fire requirements as well as the above high-height drop requirements can be satisfied are provided below.

As an example, consider a typical situation in which the firing (setback) acceleration is around 3,000 Gs and lasts up to 4 msec, which constitutes the all-fire acceleration requirement for the inertial igniter; and the no-fire requirements (in addition to the low G accelerations and decelerations due to transportation and other similar events) to be 2,000 Gs with a duration of 0.5 msec (for drops from up to 7 feet over concrete surfaces) and 18,000 Gs with a duration of 1 msec (for drops from up to 40 feet). The basic embodiment shown in FIGS. 8 and 9 can readily satisfy these all-fire and no-fire requirements with the following design parameters, noting that these parameter values are provided only for the sole purpose of illustrating how the disclosed method can be used to design inertial igniters that can satisfy a wide range of present all-fire and no-fire requirements and noting that the selected parameters do not represent their optimal values. The spring element 309 of the striker mass 301 release element 307 (FIGS. 8 and 9) is provided with a compressive preload corresponding to a force acting on the element 307 that is generated when an acceleration of 2,500 Gs acts on the inertia of the element 307. This means that for inertial igniter accelerations of up to 2,500 Gs acting in the direction of the arrow 320, the net force acting on the element 307 is upwards, i.e., does not cause the element 307 to begin to translate downwards relative to the inertial igniter structure (in the direction of releasing the locking ball 304). In addition, the spring element 326 of the deployable locking mechanism is preloaded in tension corresponding to a force acting on the element 323 that is generated when an acceleration of 3,000 Gs acts on the inertia of the element 323 and causing it to begin to slide down on the surface 322 of the fixed element 331. This means that for inertial igniter accelerations of up to 3,000 Gs acting in the direction of the arrow 320, the net force acting on the element 323 in the lateral direction is positive towards the right (as observed in FIGS. 8 and 9), i.e., the direction of preventing the element 323 from beginning to move to the left (in the direction of blocking full downward translation of the element 307 to release the locking ball 304).

Now if the no-fire condition of 7 feet drops over concrete floors (2,500 Gs) occurs, the aforementioned 2,500 G level of preloading of the spring element 309 prevents the element 307 from beginning to move and thereby rendering the inertial igniter safe to the said required 7 feet drops over concrete floors. On the other hand, if the all-fire acceleration of 3,000 G is experienced by the inertial igniter, at the 2,500 G level, the element 307 begins to move down (acted upon by a net equivalent acceleration level of 500 Gs (i.e., 3,000−2,500=500 Gs), thereby if the 3,000 G firing (setback) acceleration is applied over long enough period of time, then the element 307 travels down enough to release the striker mass 301 by allowing the locking ball 304 to move out of the dimple 305. The striker mass is then accelerated down, causing the pyrotechnics components 311 and 312 (FIG. 6) to impact and thereby initiate the thermal battery. It is noted that the aforementioned firing acceleration duration of 4 msec can be readily shown to be well beyond the firing acceleration (setback) duration needed allow the above process to be completed.

Now consider the event in which a munitions containing the inertial igniter described in FIGS. 8 and 9 is dropped from a height of 40 feet (resulting in an impact induced deceleration of the inertial igniter of the around 18,000 Gs for a duration of 1 msec). In this situation, the striker mass releasing element 307 and the deployable locking mechanism element 323 are decelerated from the same initial velocities. In addition, both elements begins their downward translation nearly at the same time and very quickly following the impact time since the 18,000 G of impact induced acceleration is generally reached in a very small fraction of the total acceleration duration of up to 1 msec. As a result, both elements 307 and 323 translate downward with nearly the same velocity profiles. However, since the element 323 requires only a small downward translation to move under the protruding portion 321 of the element 307 to prevent it from moving down enough to release the locking ball 304, therefore it would always move to the latter "locking" position and prevent the striker mass from being released and initiate the thermal battery. In fact, noting that the downward acceleration of the element 307 is approximately 500 Gs (3,000−2,500=500 Gs) higher than the downward acceleration of the element 323, thereby the element 307 closes its distance to the element 323 (indicated here as distance $d_o$) over the time t described by the relationship $$d_o=(1/2)(500\ G\times 9.8m/s^2/G)t^2 \quad (1)$$

and for a maximum duration of t=1 msec for the aforementioned impact induced acceleration level of 18,000 Gs, the above distance $d_o$ is reduced by $d_o$=2.45 mm. Thus, for example, if the element 323 has to move downwards less than 2.45 mm before being positioned below the bottom surface of the protrusion 321 of the element 307, the deployable locking mechanism illustrated in the schematics of FIGS. 8 and 9 would block the element 323 from releasing the striker mass 301, i.e., from initiating the inertial igniter. And considering the fact that the inertial igniter can be readily designed such that the element 323 has to translate down a relatively small distance before it is positioned below the protruding portion 321 of the element 307, it is seen that by selecting proper parameters for the aforementioned components of the inertial igniter and the present deployable locking mechanism, the inertial igniter can be rendered safe to the aforementioned high-height drops of up to 40 feet.

It is appreciated by those skilled in the art that in the above example, the aforementioned equivalent preloading level of the element 323 only needs to be higher than that of the equivalent preloading level of the element 307 and does not have to be as high as 500 Gs. However, in practice, this difference can be selected to be high enough to ensure reliability of the operation of the high-height drop mechanism.

It is also appreciated by those skilled in the art that as long as the equivalent preloading level of the element 323 is higher than that of the equivalent preloading level of the element 307, the high-height drop mechanism would operate properly to prevent initiation of the inertial igniter and in turn the thermal battery irrespective of the firing (setback) acceleration level and its duration (i.e., the all-fire condition). For example, the all-fire acceleration level may be 900 G, 2500 G, or 8,000 Gs, etc., with durations in the range of 4-16 msec and the inertial igniter will still be high-height drop safe (it is noted that when the all-fire setback acceleration is below 2,000 Gs with relatively long duration—usually over 8 msec—then the safety requirement for 7 feet drop over concrete floor, which results in up to 2,000 Gs of acceleration over up to 0.5 msec duration, is satisfied by the longer time (i.e., more than 0.5 msec) that the element 307 would require to translate down enough to allow the locking balls 304 to move and allow the striker mass 301 to be released—as described in the above-listed patents and patent applications.

It is also appreciated by those skilled in the art that the "two sliding block" (blocks 323 and 331) mechanism used in the embodiment 320 of FIGS. 7 and 8) is only one out of numerous possible mechanical mechanism types that can be used to achieve the required aforementioned functionality of a "deployable locking mechanism". In general, these mechanism types can be classified as follows, and with each class of such "deployable locking mechanisms" providing the indicated unique operational characteristics that make them advantageous to the indicated operational requirements:

1. A first class of deployable locking mechanisms in which once the predetermined high-height drop level induced (impact) acceleration threshold is reached, the locking mechanism (which is intended to block the release of the striker mass—in the embodiment of FIGS. 8 and 9, the element 307) is deployed and stays deployed even after the said high-height drop induced acceleration event has ended. Such a class of deployable locking mechanisms has the advantage of providing the means of preventing subsequent thermal battery initiation since high-height impacts may have damaged other components of the munitions or the like and render them unsafe if a power source (the thermal battery using the present inertial igniter) could eventually be activated as a result of certain event (for example, the shock of transportation or loading into a gun or even drops from even less than 7 feet heights).
2. A second class of deployable locking mechanisms in which once the predetermined high-height drop level induced (impact) acceleration threshold is reached, the locking mechanism is deployed. However, in contrast with the above first class of deployable locking mechanisms, when the impact induced acceleration drops below a predetermined threshold (which might be different from the aforementioned deployment acceleration threshold), the deployable locking mechanism returns substantially to its pre-deployment (i.e., pre high-drop) state. This class of deployable locking mechanisms has the advantage of providing safety against high-drop impacts, which allowing the munitions and the like to stay operational. This class of deployable locking mechanisms are appropriate for use in inertial igniters that are employed in munitions or the like that are designed not to be substantially damaged following drops from the aforementioned high-heights, thereby posing no safety and/or operational issues following such drops.

In addition, the deployable locking mechanisms corresponding to either one of the above two classes may be provided with the means to allow the user of the thermal battery or the like to determine if the high-impact drop (or any other similar events) has deployed the locking mechanism without the need to disassemble or radiate the thermal battery, and possibly without the need to disassemble the munitions or the like in which the thermal battery is used.

The deployable locking mechanism of the embodiment illustrated in the schematics of FIGS. 8 and 9 belongs to the above second class of mechanisms. In this embodiment, once the impact induced inertial igniter deceleration has ended, the aforementioned dynamic force acting on the element 323 (being in the deployed position shown in FIG. 9) is essentially ended. The element 323 is then pulled back to its original (not deployed) position shown in FIG. 8. This embodiment may, however, be modified such that once the element 323 is fully deployed as shown in FIG. 9, it is then prevented from moving back to its pre-deployment position of FIG. 8. This return motion prevention task can be performed using many different mechanisms, an example of which is in the schematic of FIG. 10. In this schematic, only the elements required to illustrate the said return motion prevention functionality of this embodiment of the present invention are shown.

Figure 10:
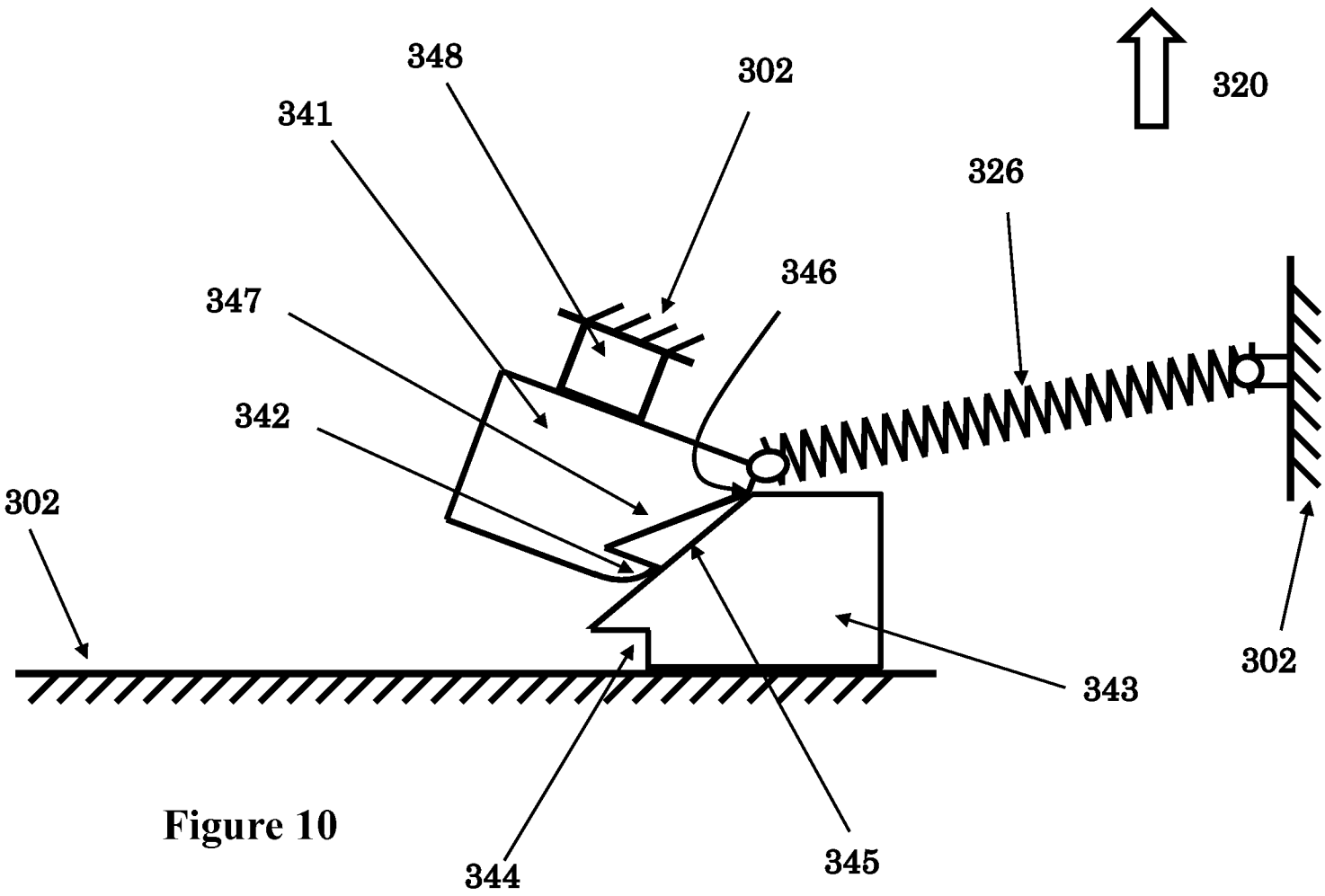
FIG. 10 illustrates a schematic of the basic inertial igniter of FIG. 8 with a modified high-height drop with deployed initiation blocking "deployable locking mechanism" that would prevent inertial igniter initiation once a high-height drop event has occurred.

As can be seen in the schematic of FIG. 10, the element 341 (element 323 in the embodiment of FIGS. 8 and 9) is provided with a protruding portion 342. The element 343

(element 331 in the embodiment of FIGS. 8 and 9) is in turn provided with a recess 344 for receiving the protruding portion 342 of the element 341 as described below. In addition the position of the stop 348 (element 329 in the embodiment of FIGS. 8 and 9) is also adjusted to properly constrain the motion of the element 341 as was previously described for the element 329 for the embodiment of FIGS. 8 and 9.

Figure 11:
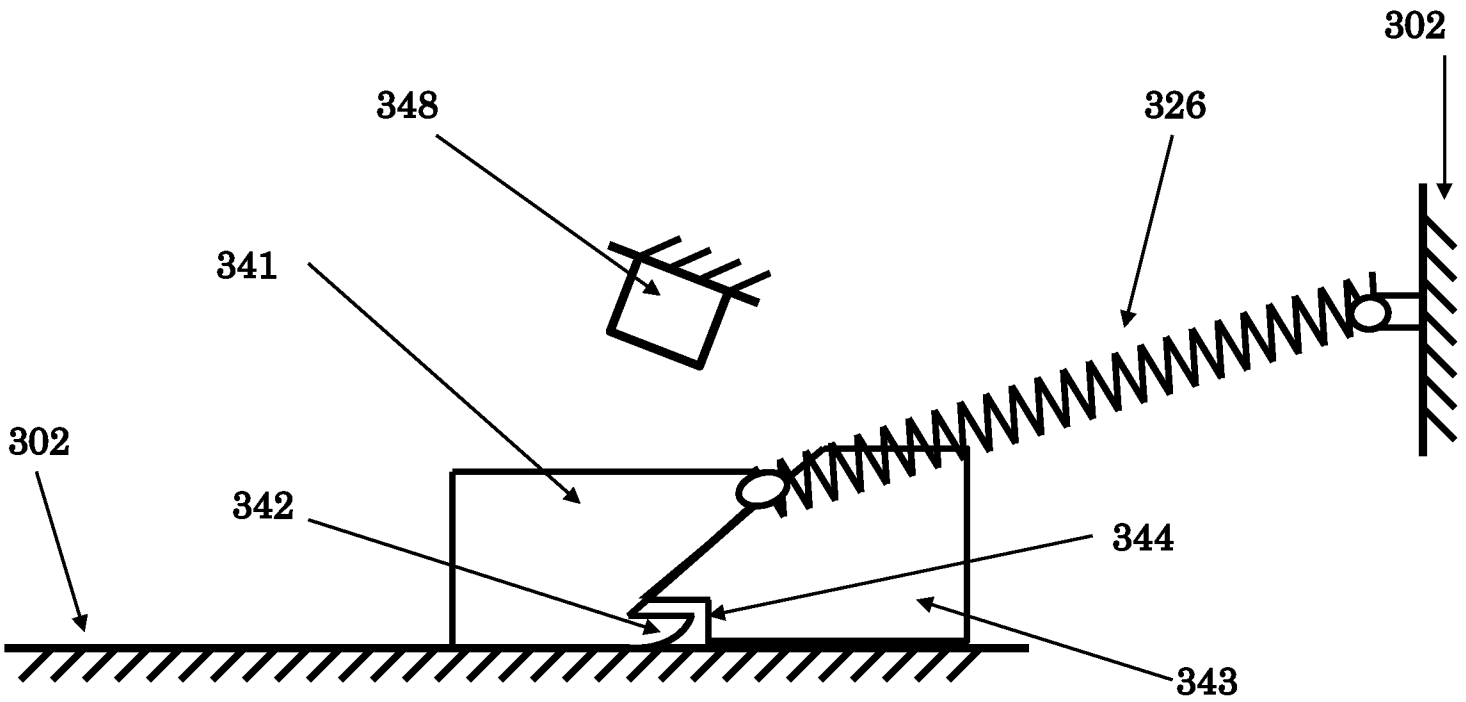
FIG. 11 illustrates a schematic of the state of the inertial igniter of FIG. 10 following a high-height drop event.

When a high-height drop event occurs and the element 341 is decelerated from its initial velocity at the time of impact, if the aforementioned net force (dynamic—due to the inertia of the element 341—and spring element 326, etc.) acting on the element 341 is high enough, then as was previously described for the element 323 of the embodiment of FIGS. 8 and 9, the element 341 would similarly slide down the inclined surface 345 of the element 343 (noting that for the case of element 341, the frontal surface of the protruding portion 342 and upper tip 346 of the surface 347 of the element 341 will be sliding down the inclined surface 345 of the element 343). The downward slide of the element 341 will then continue until it touches the bottom surface 302 of the inertial igniter structure. The element 341 is then pulled to the right by the tensile force of the spring element 326, causing the protruding portion 342 of the element 314 to engage the recess 344 of the fixed element 343. As a result, once the high-height drop impact induced acceleration has ceased, the element 341 is securely locked to the element 343 as can be seen in the schematic of FIG. 11 and can no longer return to its original (pre high-height drop) position shown in FIG. 10. As a result, the inertial igniter can no longer be initiated by the firing (setback) acceleration or the like events.

In another embodiment, "toggle" type of mechanisms are used in the deployable locking mechanism portion of the inertial igniters. Hereinafter, by "toggle" type of mechanisms it is meant those mechanisms (of linkage or non-linkage type) in which the mechanism has at least one elastic element and at least two stable minimum potential energy positions that it would tend to move to when released depending on its current position if no external load is applied to the mechanism. Such "toggle" type of deployable locking mechanisms belong to the aforementioned first class of deployable locking mechanisms. An example of such a "toggle" mechanism type of deployable locking mechanism is shown in the schematic of FIG. 12.

Figure 12:
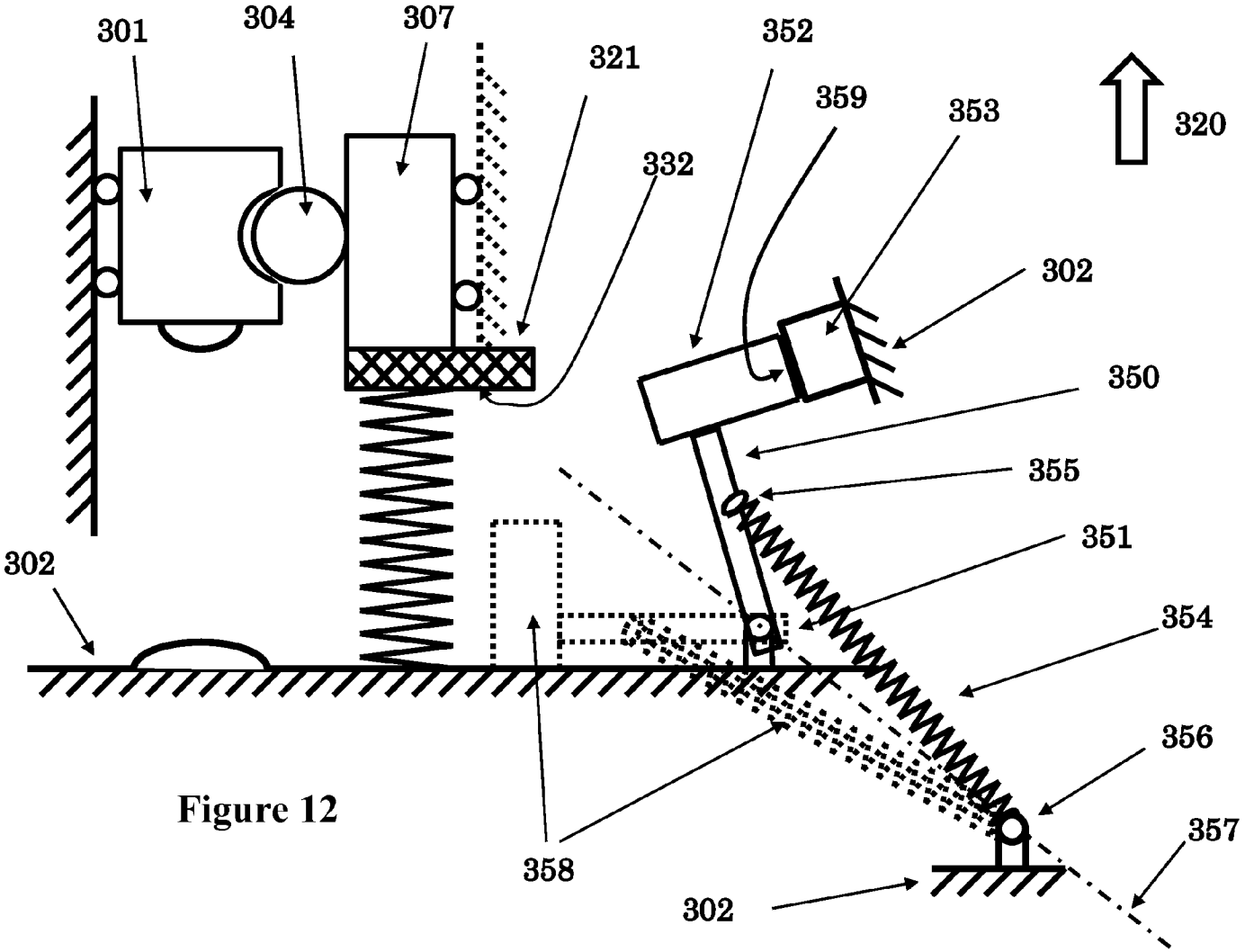
FIG. 12 illustrates a schematic of the basic components used to describe the operation of currently available mechanical inertial igniters with 7 feet drop safety mechanism with an added "toggle" type deployable locking mechanism for providing for safety (no initiation) for high-height drops from up to 40 feet.

In the schematic of FIG. 12, a toggle-type deployable locking mechanism is constructed with a link 350 which is attached to the structure of the inertial igniter 302 by a pin joint 351. A relatively rigid element 352 is attached to the free end of the link 350. Hereinafter, the link 350 and the relatively rigid element 352 are jointly referred to as the "toggle element". In its un-deployed state, the toggle element (shown in solid in the schematic of FIG. 12) rests against the stop 353 (which is fixed to the structure of the inertial igniter 302). A spring element 354 is attached on one end to the link 350 (preferably by a pin joint 355) and at the other end to the structure of the inertial igniter 302 through a pin joint 356. The spring element 354 can be preloaded in tension. The toggle element (elements 350 and 352) is designed such that its center of mass is located on the left side of the pin joint 351. As a result, when the inertial igniter is dropped from a high-height and impacts the ground or other hard surfaces such as that previously described, the toggle element is decelerated from its initial velocity at the time of the impact, the deceleration would act on the inertia of the toggle element and cause the toggle element to apply a dynamic counterclockwise torque against clockwise toque applied to the toggle element by the spring element 354. In which case, if the magnitude of the said dynamic counterclockwise torque is high enough to overcome the clockwise torque that is applied to the toggle element by the spring element 354, then the toggle element will begin to rotate in the counterclockwise direction. Now if the duration of the dynamic counterclockwise torque is also long enough, then the toggle element will begin to rotate counterclockwise, pass through the position of maximum spring force indicated by the dotted line 357 (connecting the pin joints 351 and 356), and comes to rest relative to the structure of the inertial igniter 302 when the relatively rigid element 352 comes into contact with bottom surface of the inertial igniter 302 (as shown in dotted and indicated by the numeral 358 in FIG. 12). In this configuration of the toggle element, the relatively rigid element 352 would block downward motion of the element 307 by being positioned under the protrusion portion 321 of the element 307. As a result, the locking ball 304 and thereby the striker mass 301 of the inertial igniter cannot be released and the inertia igniter cannot be initiated. In addition, noting that the toggle element is in its new (second) stable position as shown in dotted lines in FIG. 12, upon the termination of the aforementioned impact process, the toggle element stays deployed (shown dotted lines and numeral 358—FIG. 12), therefore the inertial igniter stays in the no initiation state. It is also noted that the inertial igniter would not initiate even if it is dropped a second time (even from the aforementioned high-heights of up to 40 feet) since the impact would generate a further dynamic counterclockwise torque on the toggle element (as shown in dotted and indicated by the numeral 358 in FIG. 12), which cannot be turned any further in the counterclockwise direction). It is also noted that by providing a spring element 354 of appropriate rate; preloading it in tension (at its un-deployed state, FIG. 12) to an appropriate level; selecting a proper geometry and size and shape for the toggle element (i.e., the length and inertia of the link 350 and the size, shape and mass of the relatively rigid element 352—which would also determine the overall geometry of the toggle element, location of its center of mass and its inertia characteristics), the present toggle-type deployable locking mechanism can be designed to deploy as a result of drops from high-heights such as the aforementioned up to 40 feet heights that can generate up to 18,000 G of impact induced deceleration levels for the inertial igniter.

It is also noted that as can be seen in the schematic of FIG. 12, during the impact induced counterclockwise rotation of the toggle element (thereby the link 350 and the tensile spring element 354), once the link 350 crosses the position of maximum spring force (dotted line 357), the component of the spring force perpendicular to the direction of the link (or the line connecting the pin joints 355 and 356 if the link 350 is not straight as shown in FIG. 12) would also generate a counterclockwise torque that assists the counterclockwise torque acting on the toggle element in affecting counterclockwise rotation of the toggle element. As a result, by proper selection of the geometrical, inertia and spring rate parameters of the deployable locking mechanism of the toggle mechanism type embodiment of FIG. 12 of the present invention, the time that it would otherwise take for the deployable locking mechanism to deploy is significantly reduced. As a result, for applications such as the one provided in the aforementioned example, the distance $d_o$, equation (1), that needs to be provided between the bottom surface 332 of the protruding portion 321 of the element 307, FIG. 8, and the top surface 359 of the element 352 of the toggle element can be less than the calculated $d_o$=2.45 mm. This characteristic of toggle mechanism type of deployable locking mechanisms has the advantage of allowing inertial igniters to be designed with smaller required heights.

Figure 13:
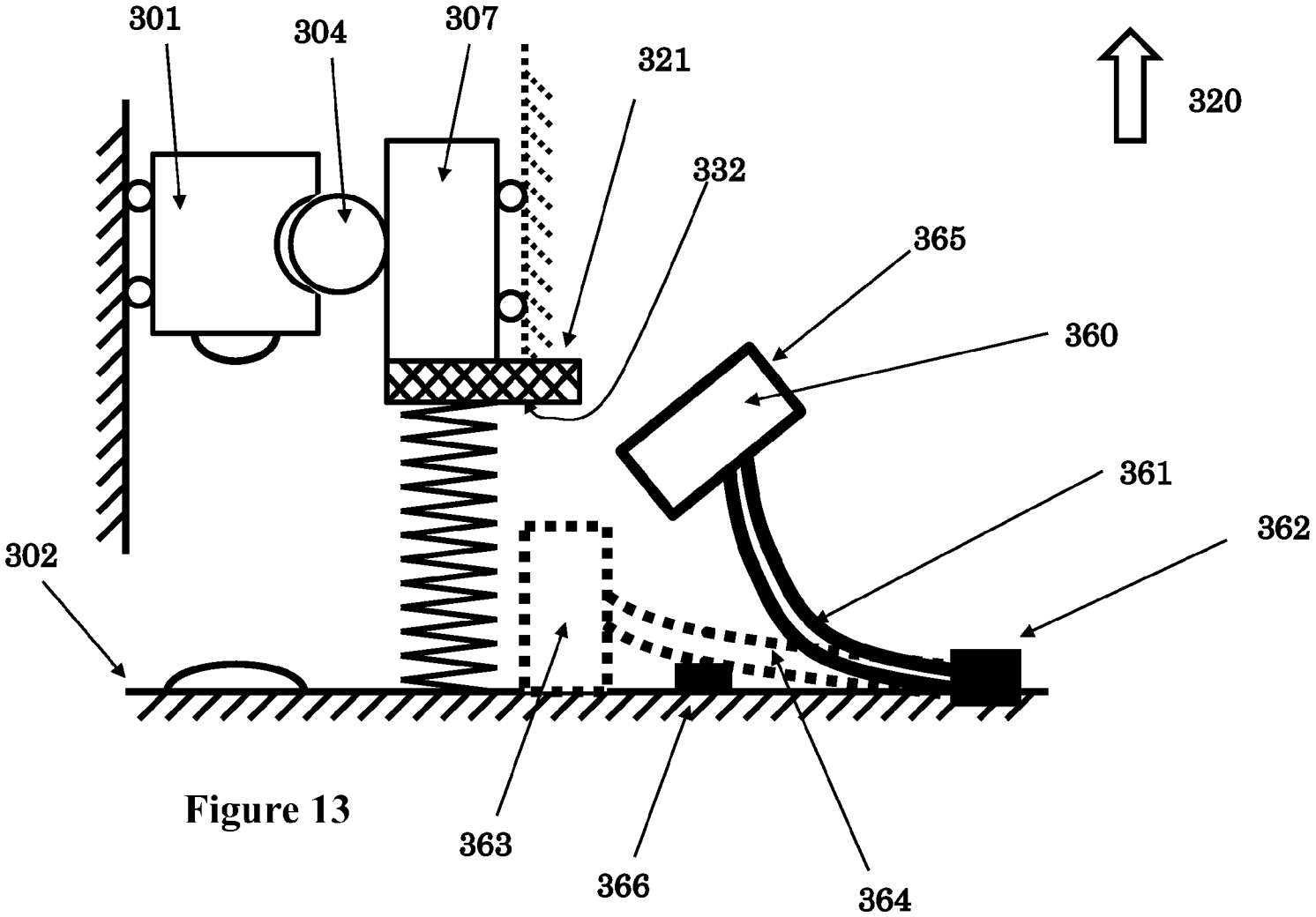
FIG. 13 illustrates a schematic of the basic components used to describe the operation of currently available mechanical inertial igniters with 7 feet drop safety mechanism with an added deforming deployable locking mechanism for providing for safety (no initiation) for high-height drops from up to 40 feet.
Figure 14:
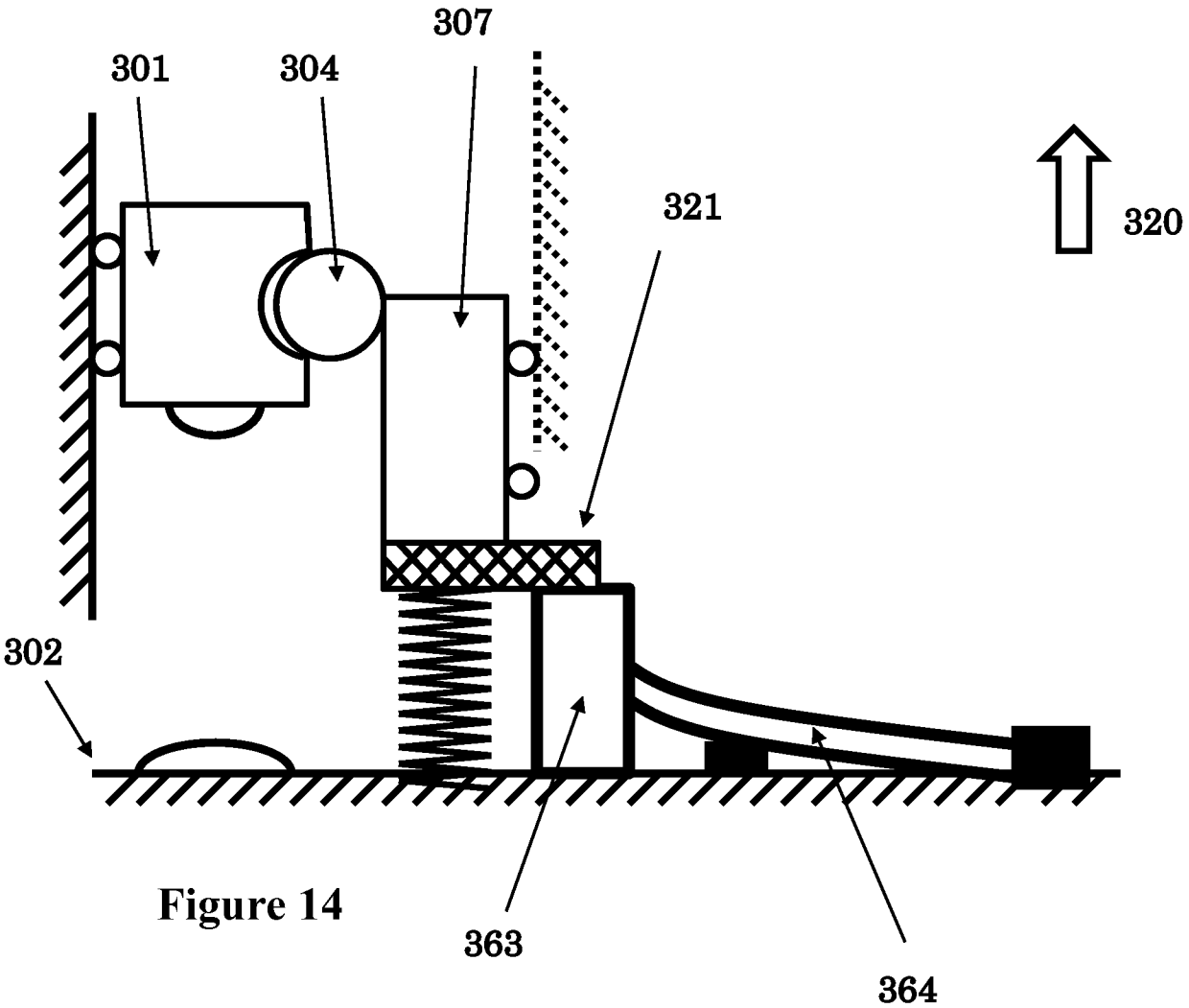
FIG. 14 illustrates a schematic of the basic inertial igniter of FIG. 13 following a high-height drop with deployed initiation blocking "deployable locking mechanism".

Another embodiment is shown in the schematic of FIG. 13. This type of deployable locking mechanism belongs to the aforementioned first class of deployable locking mechanisms. In the embodiment, a relatively rigid element 360 is attached to the structure of the inertial igniter 302 at the point 362 by a deforming (such as beam type flexural) element 361. If the inertial igniter is dropped from a high-height (such as from the aforementioned height of up to 40 feet, which could cause the inertial igniter structure to be decelerated at a rate of up to 18,000 Gs), the impact induced deceleration of the inertial igniter structure would cause the relatively rigid element 360 and the "beam" element 361 to be decelerated from their initial velocity at the time of impact. The deceleration acts on the inertia of the relatively rigid element 360 and the beam element 361, resulting in a dynamic force that tends to push the elements down. The relatively rigid element 360 can be more massive than the beam element 361, thereby causing the resultant dynamic force to act closer to the relatively rigid element 360 side of the beam 361. The beam element 361 is preferably designed to deform elastically up to certain level of applied (dynamic) force, and deform plastically above that level of applied force, causing the beam element 361 to be deformed permanently before it comes into full contact with the bottom surface of the inertial igniter 302. If the aforementioned magnitude of downward deceleration applied to the elements 360 and 361 is up to or below the level that of firing (all-fire), i.e., setback acceleration or up to or below the magnitude of the deceleration level reached if the inertial igniter is dropped from up to 7 feet over a concrete floor (i.e., 2,000 Gs or the like according to the no-fire safety requirement), then the beam element 361 is designed to deform elastically downward less than the amount that is required to position the relatively rigid element 360 in the path of downward translation of the element 307 and its protruding portion 321, FIG. 13. On the other hand, when the inertial igniter is dropped from a high-height of up to 40 feet and the inertial igniter impacts the ground such that its structure is decelerated in a direction parallel to the arrow 320 at rates of up to 18,000 Gs, then the aforementioned downward dynamic force acting on the elements 360 and 361 causes the beam 361 to bend beyond its elastic limit and plastically deform until the relatively rigid element 360 comes into contact with the bottom surface of the inertial igniter structure 302 (shown in dotted lines and enumerated as 363), and the beam element 361 deforms and comes to rest as shown in dotted lines and enumerated as 364, FIG. 13. As a result, the relatively rigid element 360 is positioned below the protruding portion 321 of the element 307, preventing the element 307 from moving down enough to release the locking ball 304 and thereby the striker mass 301 as shown in FIG. 14. It is noted that once the drop impact induced downward acceleration of the elements 360 and 361 has ended, the beam element 361 would in general rebound slightly due to certain amount stored elastic potential energy, but the beam element 361 is readily designed such that the amount of rebound would still position the top surface 365 of the relatively rigid element 360 below the bottom surface 332 of the element 307 and/or its protruding portion 321.

It is appreciated by those skilled in the art that the geometry of the beam element 361 can be designed and it could also, for example, be provided with sharp enough notches (not shown) to facilitate its plastic deformation and the final shape of its plastically deformed configuration and even minimize the level of its aforementioned rebound. In addition, certain bulging element(s) 366 shown in FIG. 13 may be provided over the bottom surface of the inertial igniter surface 302 and under the deforming beam element 361 (or on the bottom surface of the beam itself) to force the beam element to deform in a predetermined pattern to better position the relatively rigid element 360 under the bottom surface 332 of the element 307 and/or its protruding portion 321.

It is also appreciated by those skilled in the art that the deployable locking mechanism of the embodiment shown in FIGS. 13 and 14, i.e., the elements 360 and 361, may be biased against deforming downwards to their deployed configuration of FIG. 14, for example by providing preloaded compressive spring (not shown) under element 360 and/or 361 while providing stops to prevent their upward motions (similar to the stop 353 in FIG. 12). By providing such biasing spring elements (or the like), the deployable locking mechanism is prevented from beginning deployment unless the applied downward acceleration is above certain threshold, such as above the all-fire setback acceleration or deceleration experienced when the inertial igniter is dropped from heights of over 7 feet height.

In each one of the schematics of the disclosed embodiments shown in FIGS. 6-14, only one deployable locking mechanism is shown to be used. However, it is appreciated by those skilled in the art that more than one deployable locking mechanism can be used for several reasons, including the following. Firstly, by using more than one deployable locking mechanism, the inertial igniter safety against the aforementioned high-height drops becomes more reliable by providing more than one auxiliary deployable locking mechanisms that operate independently. Secondly, by providing more than one downward translation blocking stops for the element 307 (usually a sleeve with circular cross-section—FIGS. 6-9 and 12-14) by deployable locking mechanisms—such as at least 3 elements that are positioned symmetrically around the element 307—the element 307 is more uniformly supported during high-height drop induced downwards deceleration induced impact with the stops deployed by the deployable locking mechanisms. As a result, the chances that the element (sleeve) 307 becomes jammed along its path of motion are minimized.

When several deployable locking mechanisms are used in the design of an inertial igniter, the fixed component of the mechanism—such as the element 331 of the embodiment of FIGS. 8 and 9, element 343 of the embodiment of FIGS. 10 and 11, or the element 362 in the embodiment of FIG. 13—may be integral, and can be integral to the structure of the inertial igniter. In fact, the inertial igniters can be constructed with as few parts as possible. In addition, all the pin joints used in such deployable locking mechanisms can be living joints. For example, multiple deployable locking mechanisms of the type of embodiment of FIGS. 13 and 14 can be designed to be fabricated as one single piece, such as a symmetrical ring-shaped structure shown schematically in FIGS. 15 and 16.

Figure 16:
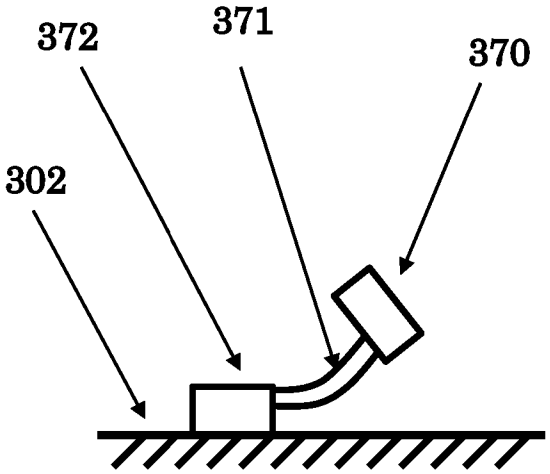
FIG. 16 illustrates the cross-sectional view A-A of one of the deployable locking mechanisms of the embodiment of FIG. 15.
Figure 15:
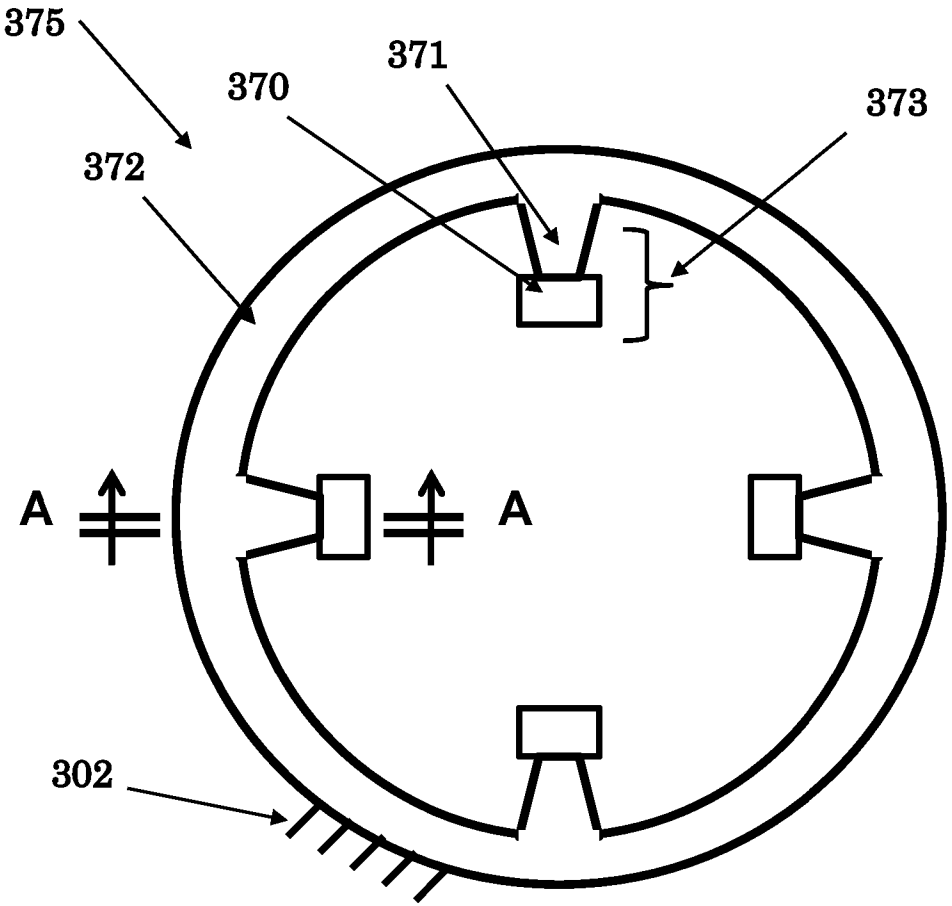
FIG. 15 illustrates a schematic of a deforming multi-deployable-locking-mechanism that is constructed as a complete ring for positioning around the inertial igniter as shown in FIG. 17.

In the schematics of FIG. 15 and the cross-sectional view A-A shown in FIG. 16, the deployable locking mechanism is shown to consist of more than one "locking elements" 370 which are connected via a (preferably flexural) beam elements 371 to the base (ring) structure 372. The "locking element" and the beam element units (together enumerated as elements 373) are preferably positioned symmetrically around the ring element 372. The ring structure is in turn fixed to the base structure 302 of the inertia igniter (other components of the inertial igniter are not shown). The present embodiment functions as previously described for the embodiment of FIGS. 13 and 14. The present embodiment is preferably fabricated as an integral component.

Figure 1:
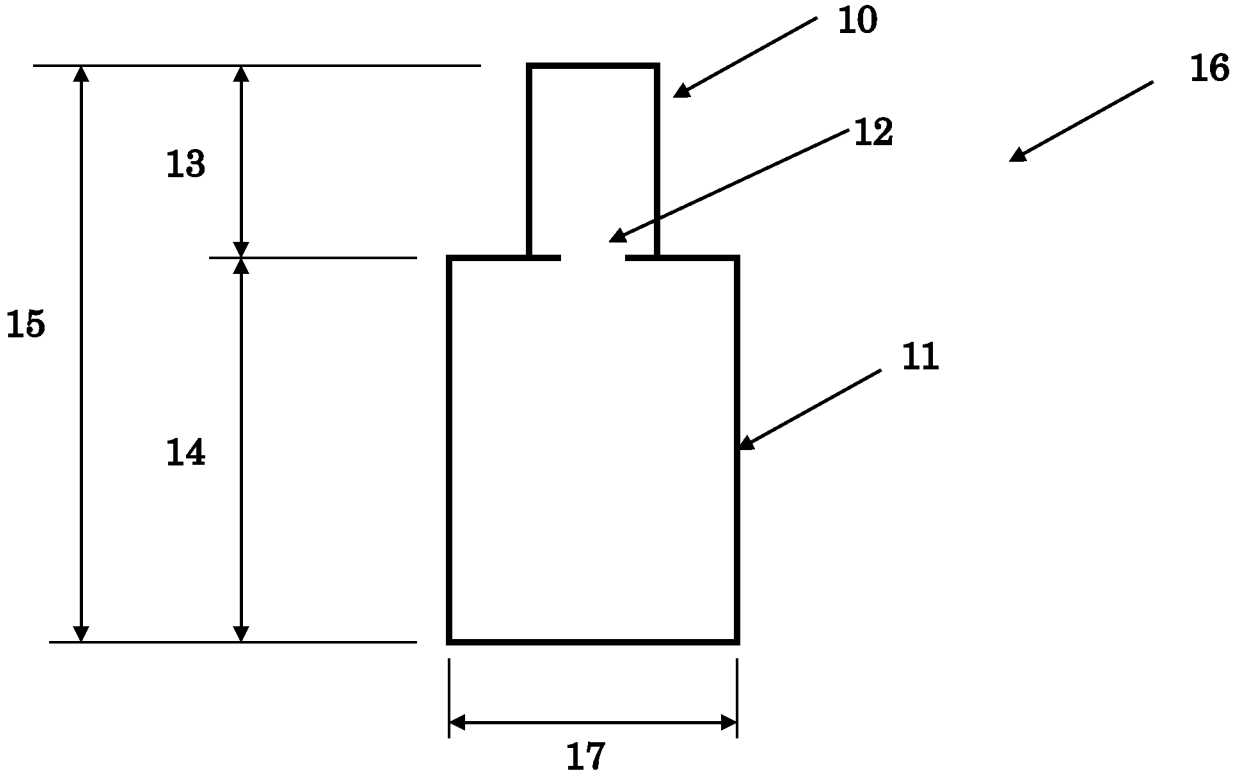
Figure 1 (Prior Art)
FIG. 1 illustrates a schematic of a cross-section of a thermal battery and inertial igniter assembly.
Figure 2:
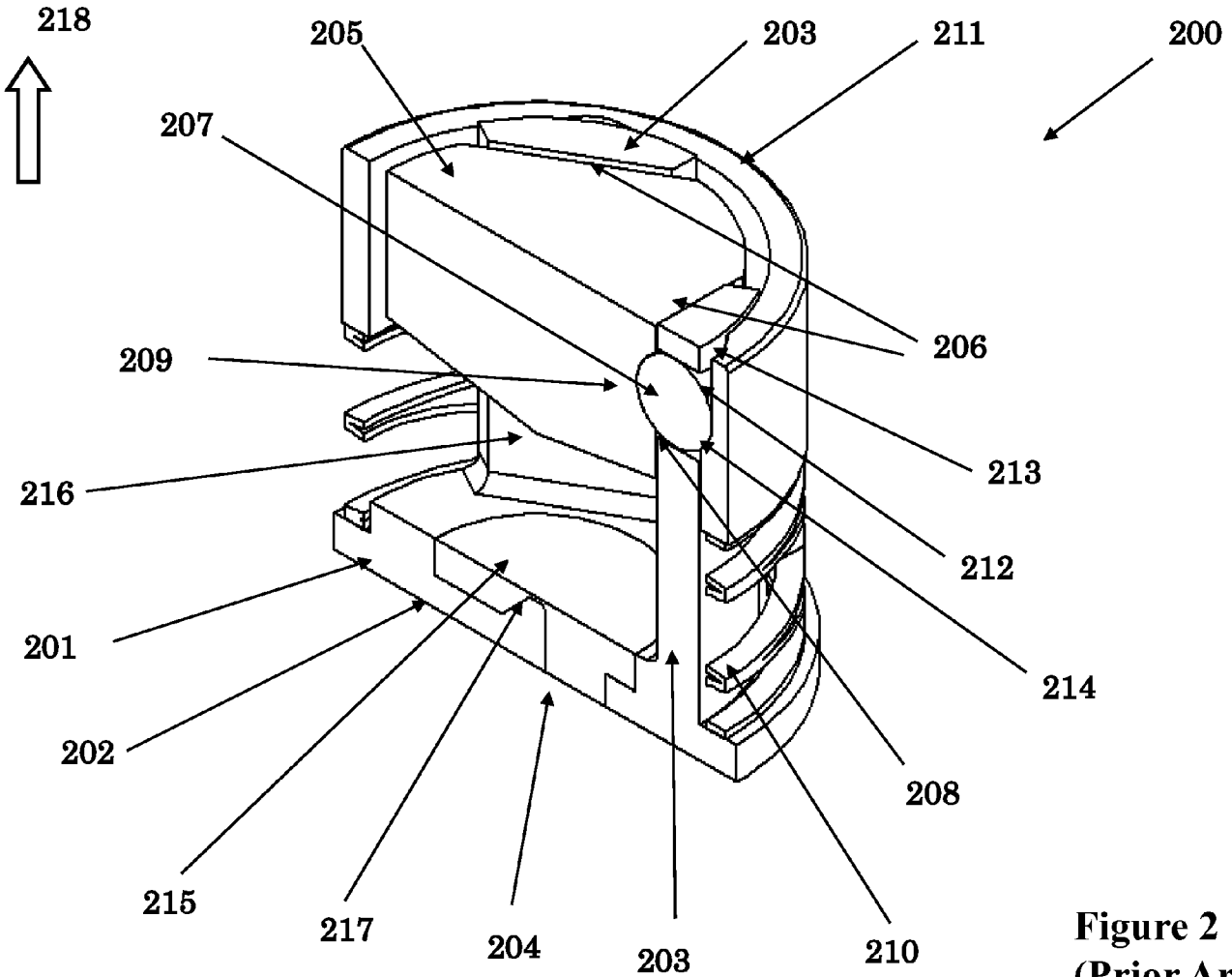
Figure 2 (Prior Art)
FIG. 2 illustrates a schematic of a cross-section of an inertial igniter for thermal battery described in the prior art.
Figure 3:
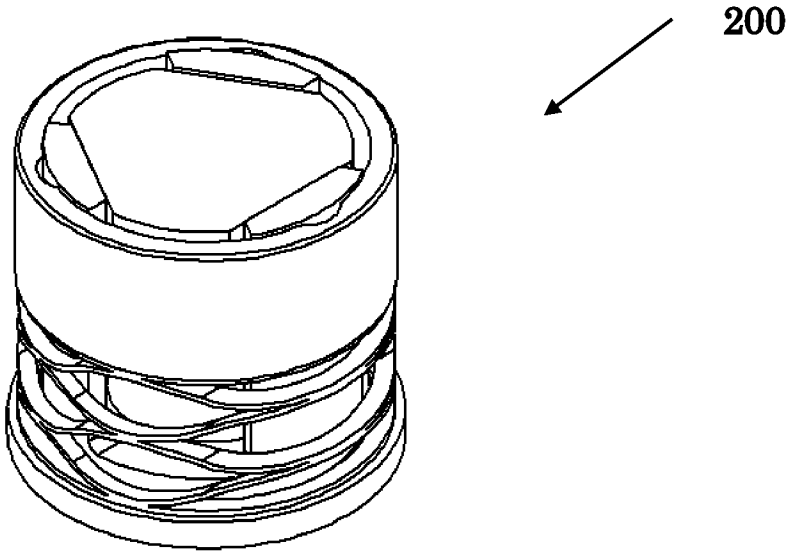
Figure 3 (Prior Art)
FIG. 3 illustrates a schematic of the isometric drawing of the inertial igniter for thermal battery of FIG. 2.
Figure 4B:
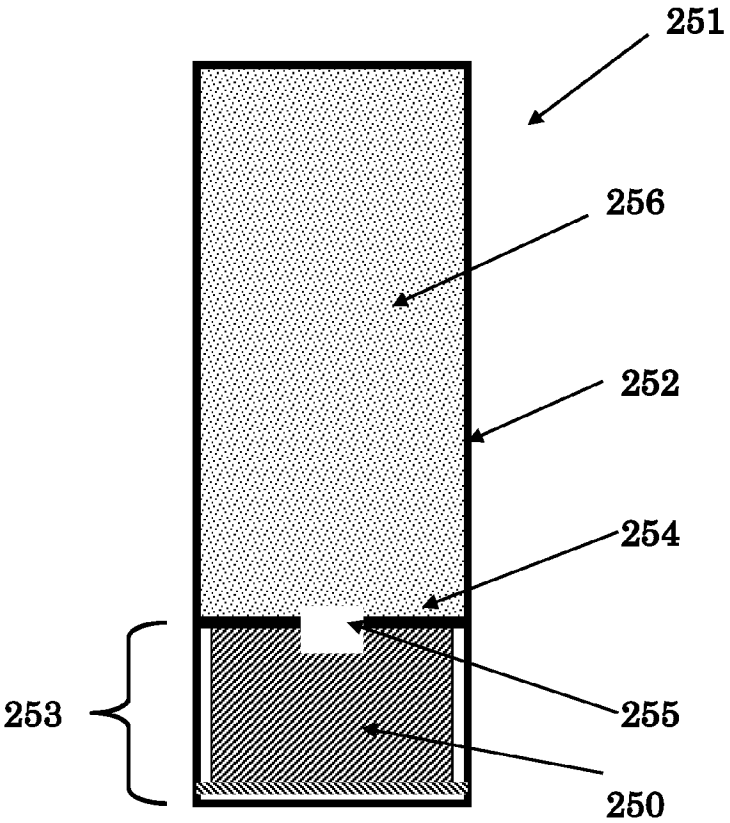
Figure 4b (Prior Art)
FIG. 4*b* illustrates a schematic of a cross-section of a thermal battery with an inertial igniter positioned on the bottom portion of the thermal battery and in which the ignition generated flame to be directed upwards into the thermal battery compartment.
Figure 4A:
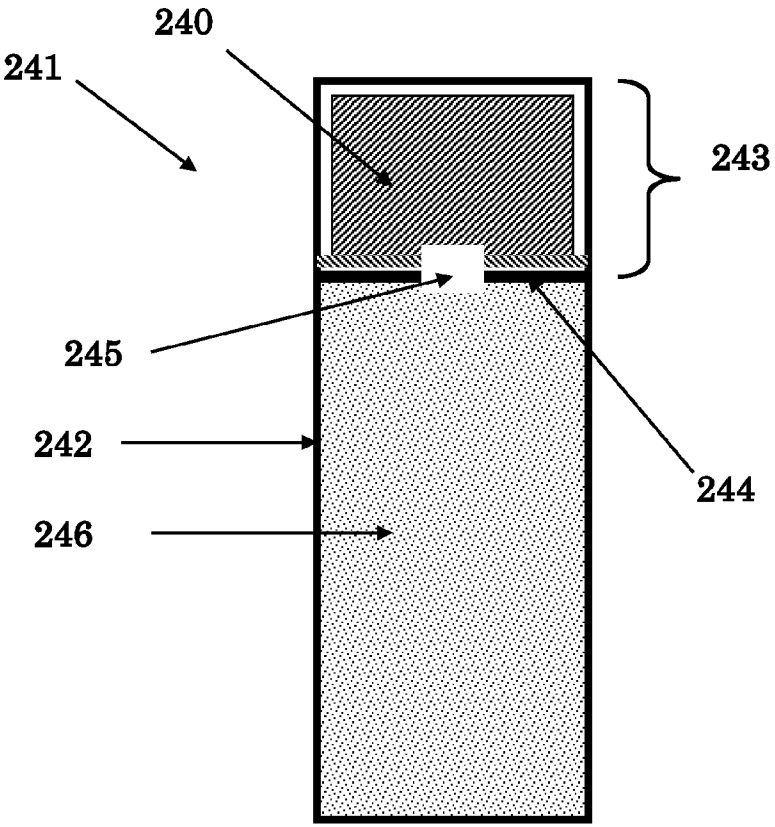
Figure 4a (Prior Art)
FIG. 4*a* illustrates a schematic of a cross-section of a thermal battery with an inertial igniter positioned on the top portion of the thermal battery and in which the ignition generated flame to be directed downwards into the thermal battery compartment.
Figure 5:
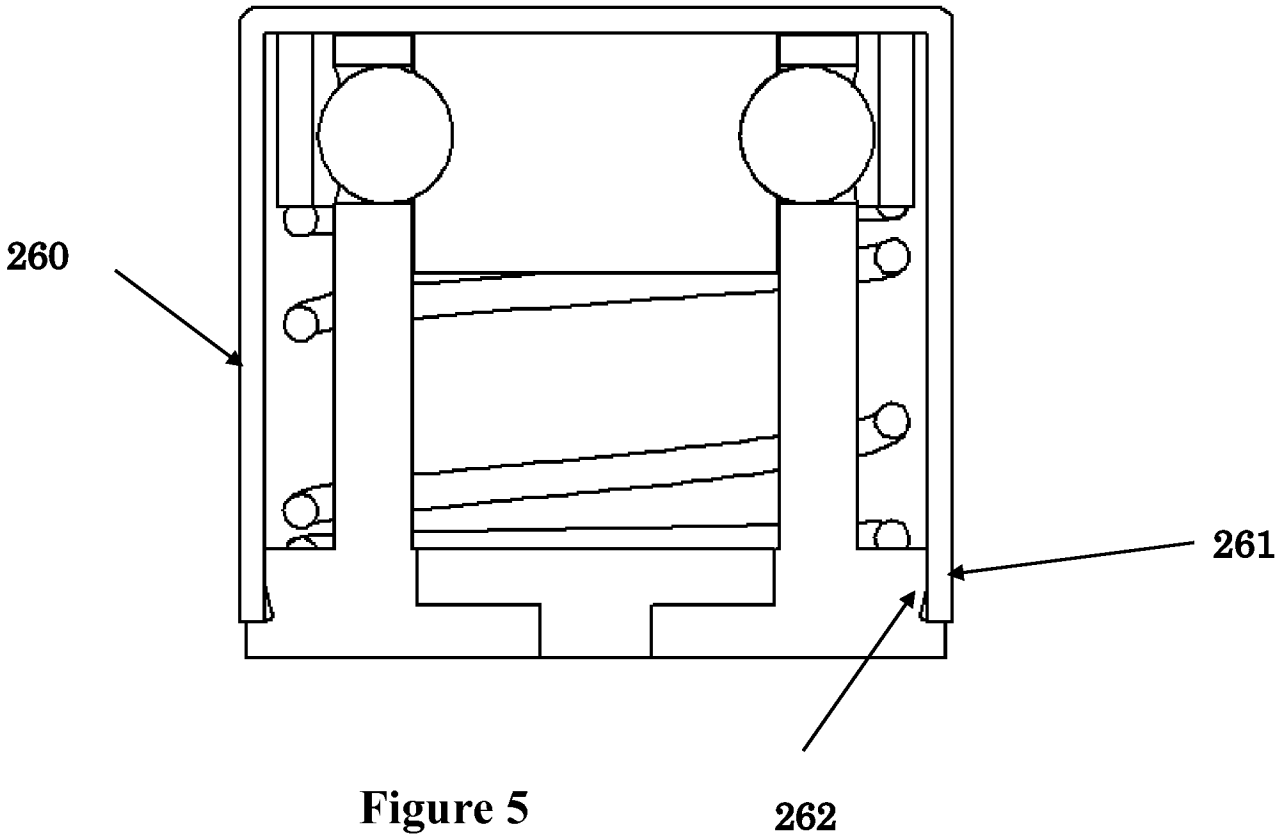
Figure 5 (Prior Art)
FIG. 5 illustrates a schematic of cross-section of an inertial igniter for thermal battery described in prior art with an outer housing.
Figure 17:
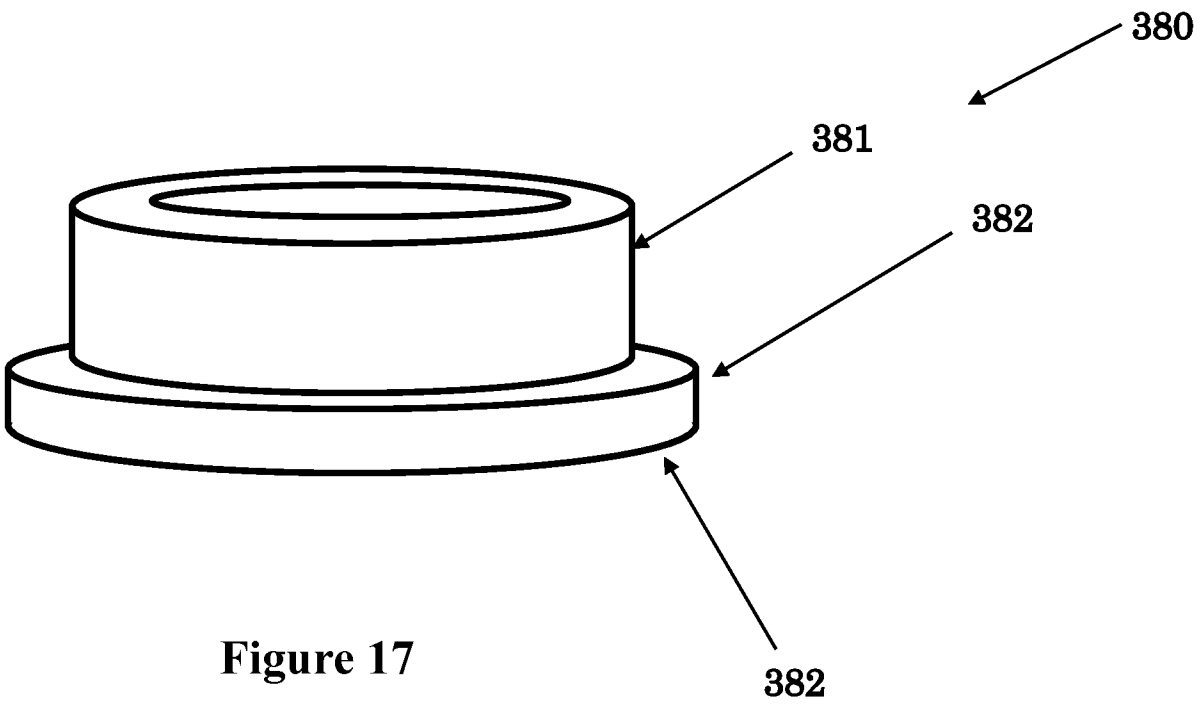
FIG. 17 illustrates a schematic of the isometric drawing of a possible modification of the striker mass locking collar of the inertial igniter of FIGS. 2 and 3 to allow for integration of a deployable locking mechanism.

In one preferred embodiment, one of the aforementioned existing inertial igniters, such as the one shown in FIGS. 2 and 3, is modified to provide it with one of the disclosed "deployable locking mechanisms". To this end, the following simple modifications are only required to be implemented. Firstly, the collar 211 of the inertial igniter shown in FIG. 2 (which corresponds to the element 307 in FIG. 6), is provided with a flange as shown in FIG. 17. In FIG. 17, the above collar 211 portion of the resulting modified collar 380 is indicated by the numeral 381 and the said provided flange with the numeral 382. It is noted that the flange 382 in the schematic of FIG. 17 corresponds to the protruding portion 321 of the element 307 in the schematic of FIG. 8. With the resulting modification to the element 211 of the inertial igniter of FIGS. 2 and 3, the user may integrate any one of the disclosed deployable locking mechanisms to make the device safe against the aforementioned drops from high-heights. For example, the ring-type multi-deployable-locking-mechanisms element 375 shown in FIG. 15 can be readily fixed to the base 201 (to be extended outwards to provide the required base for attaching the element 375), to provide a high-height-drop-safe inertial igniter for use in various gun-fired munitions, mortars and the like.

In another embodiment, certain means are provided that could be used to examine the thermal battery using the present high-height drop safe inertial igniters to determine whether the deployable locking mechanism has been activated without having to disassemble the thermal battery. In this embodiment, electrical contacts are provided such that once the deployable locking mechanism is deployed (whether stays deployed such as in the aforementioned first class of deployable locking mechanisms or returns to its pre-deployed state such as in the aforementioned second class of deployable locking mechanisms), it becomes possible for the deployment event to be detected. In this embodiment, such a capability is provided by one or more of the following means or the like:

1. Electrically isolated electrical contacts are provided between the contacting elements of the deployable locking mechanisms in which the contacts are lost when the mechanism is deployed, for example, by providing such electrical contacts between the elements 329 and 323 in the embodiment of FIG. 8, or the elements 341 and 348 in the embodiment of FIG. 10, or the elements 352 and 353 of the embodiment of FIG. 12 (none shown in such Figures).
2. Electrically isolated electrical contacts are provided on elements of the deployable locking mechanisms and/or other components of the inertial igniter such that once the said mechanism is deployed, contact is established between the two electrical contacts, for example, by providing such electrical contacts between the elements 323 and the inertial igniter structure 302 of the embodiment of FIG. 8, or between the elements 341 and the inertial igniter structure 302 of the embodiment of FIG. 10, or between the elements 352 and the inertial igniter structure 302 of the embodiment of FIG. 12, or between the elements 360 and the inertial igniter structure 302 of the embodiment of FIG. 13.
3. The means to detect the deployment of the "deployable locking mechanism" such as by providing sensors to detect to motion of the element 323 or the spring element 326 of the embodiment of FIG. 8, or the elements 341 or the spring element 326 of the embodiment of FIG. 10, or the elements 350, 352 or the spring element 354 of the embodiment of FIG. 12, or the elements 360 or 361 of the embodiment of FIG. 13.

In the embodiments of FIGS. 8-16, the disclosed "deployable locking mechanisms" are used to limit the translation of the element (in the above cases the element 307, FIG. 6) that prevents the release of certain striker mass (in the above cases the element 301) that would initiate the inertial igniter. It is appreciated by those skilled in the art that the disclosed deployable locking mechanisms may also be used to block translational, rotational or any other type of motions that components of any other type of inertial igniter must undergo to initiate the inertial igniter initiation process.

It is also appreciated by those skilled in the art that the disclosed deployable locking mechanisms can also be used with the so-called electrical G switches with mechanical time delays similar to the aforementioned inertial igniters such as those disclosed in U.S. patent application Ser. No. 12/623,442 (the entire contents of which is incorporated herein by reference) to provide them with the means to prevent the intended operation of the electrical G switches when similar high-height drop events are encountered.

It is also appreciated by those skilled in the art that more than one such disclosed "deployable locking mechanism" can be provided to the inertial igniters or the electrical G switches and directed in different directions so that if the inertial igniter of the G switch (or the device using these elements) are dropped and impact a relatively hard surface in more than one direction, one of the employed deployable locking elements could deploy and prevent the inertial igniter from initiating or the electrical G switch from being activated. For example, one may provide three such deployable locking mechanisms and form a tri-axial (e.g., oriented in three orthogonal directions) and thereby design them to deploy when the inertial igniter or the device employing it is dropped from relatively high-heights (e.g., from the aforementioned heights of up to 40 feet).

It is also appreciated by those skilled in the art that the disclosed "deployable locking mechanisms" may be designed for different all-fire and no-fire (drops from up to 7 feet heights over concrete floor, drops from heights of around 40 feet causing up to 18,000 Gs of impact deceleration, etc.) by adjusting the parameters of the inertial igniter and/or the deployable locking mechanism.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for initiating a thermal battery, the method comprising:

releasing an engagement between an element and a striker mass upon an acceleration time and magnitude greater than a first threshold such that the striker mass is movable towards one of a percussion cap or pyrotechnic material; and moving at least one member into a path of the element to prevent the element from releasing the striker mass only where the acceleration time and magnitude is greater than a second threshold, the second threshold being greater than the first threshold.

2. The method of claim 1, wherein the moving comprises translating the at least one member into the path.

3. The method of claim 1, wherein the moving comprises rotating the at least one member into the path.

4. The method of claim 1, further comprising returning the at least one member from the path when the acceleration time and magnitude lowers from the second threshold.

5. The method of claim 1, further comprising maintaining the at least one member in the path after the acceleration time and magnitude reaches the second threshold.

* * * * *